US010437184B2

(12) United States Patent
Koido

(10) Patent No.: US 10,437,184 B2
(45) Date of Patent: Oct. 8, 2019

(54) IMAGE FORMING APPARATUS

(71) Applicant: Oki Data Corporation, Minato-ku, Tokyo (JP)

(72) Inventor: Kenji Koido, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 15/875,450

(22) Filed: Jan. 19, 2018

(65) Prior Publication Data

US 2018/0217535 A1 Aug. 2, 2018

(30) Foreign Application Priority Data

Jan. 31, 2017 (JP) ..... 2017-015496

(51) Int. Cl.

| | |
|---|---|
| ***G03G 15/01*** | (2006.01) |
| ***G03G 15/20*** | (2006.01) |
| ***G03G 15/00*** | (2006.01) |
| *G03G 15/16* | (2006.01) |
| *G03G 13/22* | (2006.01) |
| *G03G 13/20* | (2006.01) |

(Continued)

(52) U.S. Cl.

CPC ..... *G03G 15/2039* (2013.01); *G03G 15/6585* (2013.01); *G03G 13/01* (2013.01); *G03G 13/16* (2013.01); *G03G 13/20* (2013.01); *G03G 13/22* (2013.01); *G03G 15/1605* (2013.01); *G03G 15/2017* (2013.01)

(58) Field of Classification Search

CPC ..... G03G 15/2039; G03G 15/6585; G03G 15/1605; G03G 15/2017; G03G 13/01; G03G 13/16; G03G 13/20; G03G 13/22

See application file for complete search history.

(56) References Cited

U.S. PATENT DOCUMENTS 6,835,918 B2 * 12/2004 Kagawa ..... H05B 1/0241 219/216
9,857,737 B2 * 1/2018 Unagida ..... G03G 15/2014

(Continued)

FOREIGN PATENT DOCUMENTS

JP 2002-287566 A 10/2002

*Primary Examiner* — David M. Gray
*Assistant Examiner* — Michael A Harrison
(74) *Attorney, Agent, or Firm* — Panitch Schwarze Belisario & Nadel LLP

(57) ABSTRACT

An image forming apparatus includes a developing section, a transfer section, and a fixing section. The developing section attaches a metal-containing toner to a latent image, and attaches a non-metal-containing toner to the latent image. The transfer section transfers, onto an intermediate transfer medium, the metal-containing toner and transfers, onto a print medium, the metal-containing toner. The transfer section transfers, onto the intermediate transfer medium, the non-metal-containing toner and transfers, onto the print medium, the non-metal-containing toner. The fixing section fixes, to the print medium, the metal-containing toner, and fixes, to the print medium, the non-metal-containing toner. The fixing section causes a temperature at which the metal-containing toner is fixed to the print medium to be lower than a temperature at which the non-metal-containing toner is fixed to the print medium.

9 Claims, 9 Drawing Sheets

(51) Int. Cl.
*G03G 13/16* (2006.01)
*G03G 13/01* (2006.01)

(56) References Cited

U.S. PATENT DOCUMENTS

2005/0245694 A1* 11/2005 Matsumura ..... C08L 67/02
525/437
2015/0205229 A1* 7/2015 Hara ..... G03G 15/1605
399/299

* cited by examiner

IMAGE FORMING APPARATUS

CROSS REFERENCE TO RELATED APPLICATIONS

The present application claims priority from Japanese Patent Application No. 2017-015496 filed on Jan. 31, 2017, the entire contents of which are hereby incorporated by reference.

BACKGROUND

The technology relates to an image forming apparatus provided with a fixing unit that fixes a toner to a medium.

An image forming apparatus using an electrophotographic scheme is in widespread use. One reason for this is that the image forming apparatus using the electrophotographic scheme is able to achieve a high-quality image in a short time, compared with an image forming apparatus using other scheme such as an inkjet scheme.

The image forming apparatus using the electrophotographic scheme includes a fixing unit that fixes a toner to a medium. The fixing unit includes a heating member and a pressure applying member. The heating member heats the medium onto which the toner has been transferred. The pressure applying member applies a pressure onto the medium onto which the toner has been transferred. In a process of forming an image, the toner attached to a latent image is transferred onto the medium, and thereafter, the medium is applied with the pressure while being heated by the fixing unit. As a result, the toner is fixed to the medium, resulting in formation of the image.

Various proposals have been made already for a configuration of the image forming apparatus provided with the fixing unit. For example, a fixing temperature is varied when images are successively formed, in order to suppress failure in fixing the toner, for example, as disclosed in Japanese Unexamined Patent Application Publication No. 2002-287566. In this case, the fixing temperature is varied from a first fixing temperature to a second fixing temperature in a stepwise manner, and the fixing temperature is kept thereafter.

SUMMARY

Specific consideration has been given to stable formation of a high-quality image regarding an image forming apparatus provided with a fixing unit. However, the stable formation of the high-quality image has not been achieved sufficiently yet, which still leaves room for improvement.

It is desirable to provide an image forming apparatus that is able to stably form a high-quality image.

According to one embodiment of the technology, there is provided an image forming apparatus including a developing section, a transfer section, and a fixing section. The developing section attaches a metal-containing toner to a latent image, and attaches a non-metal-containing toner to the latent image. The metal-containing toner includes a metal-containing colorant. The non-metal-containing toner does not include the metal-containing colorant. The transfer section transfers, onto an intermediate transfer medium, the metal-containing toner attached to the latent image and transfers, onto a print medium, the metal-containing toner transferred onto the intermediate transfer medium. The transfer section transfers, onto the intermediate transfer medium, the non-metal-containing toner attached to the latent image and transfers, onto the print medium, the non-metal-containing toner transferred onto the intermediate transfer medium. The fixing section fixes, to the print medium, the metal-containing toner transferred onto the print medium, and fixes, to the print medium, the non-metal-containing toner transferred onto the print medium. The fixing section causes a temperature at which the metal-containing toner is fixed to the print medium to be lower than a temperature at which the non-metal-containing toner is fixed to the print medium.

According to one embodiment of the technology, there is provided an image forming apparatus including a developing section, a transfer section, and a fixing section. The developing section attaches a toner to a latent image. The transfer section transfers, onto an intermediate transfer medium, the toner attached to the latent image, and transfers, onto a print medium, the toner transferred onto the intermediate transfer medium. The fixing section includes a heating member and a pressure applying member, and fixes, to the print medium, the toner transferred onto the print medium. The heating member is disposed on side of the intermediate transfer medium on which the print medium comes into contact with the intermediate transfer medium and heats the print medium onto which the toner has been transferred. The pressure applying member faces the heating member and applies a pressure onto the print medium onto which the toner has been transferred. The difference ΔT between a temperature of the pressure applying member and a glass-transition temperature of the toner defined as the temperature of the pressure applying member minus the glass transition temperature of the toner satisfies the following conditional expression, when the fixing section fixes the toner to the print medium.

$$68^\circ\ \text{C.} \leq \Delta T \leq 101^\circ\ \text{C.}$$

According to one embodiment of the technology, there is provided an image forming apparatus including a controller, a developing section, a transfer section, and a fixing section. The controller switches between a first mode and a second mode. The first mode forms, by use of a toner, an image on one side of a print medium. The second mode forms, by use of the toner, the image on both sides of the print medium. The developing section attaches the toner to a latent image. The transfer section transfers, onto an intermediate transfer medium, the toner attached to the latent image, and transfers, onto the print medium, the toner transferred onto the intermediate transfer medium. The fixing section includes a heating member and a pressure applying member, and fixes, to the print medium, the toner transferred onto the print medium. The heating member heats the print medium onto which the toner has been transferred. The pressure applying member applies a pressure onto the print medium onto which the toner has been transferred. The fixing section causes a temperature of the pressure applying member in the second mode to be lower than a temperature of the pressure applying member in the first mode.

DETAILED DESCRIPTION

Figure 1:
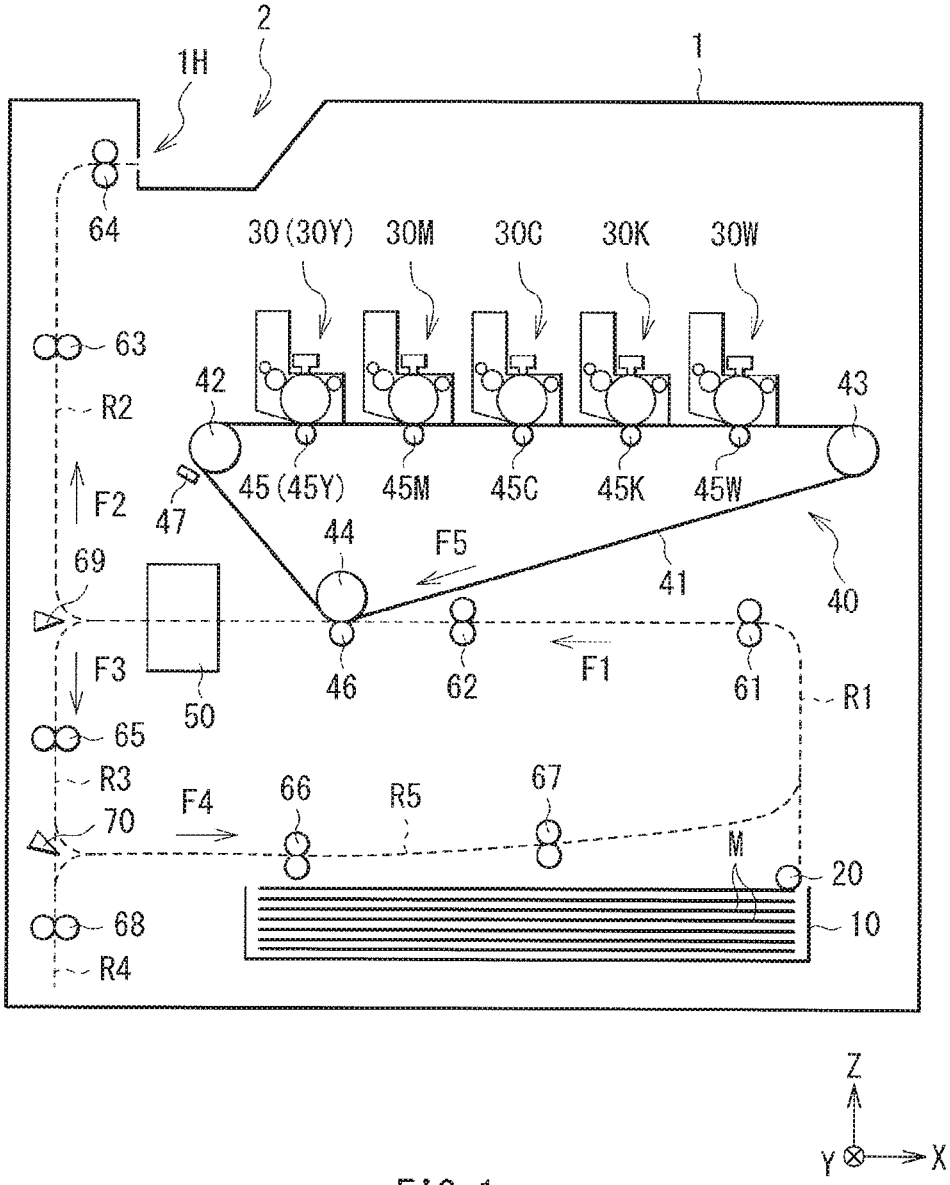
FIG. 1 is a plan view of an example of a configuration of an image forming apparatus according to a first example embodiment of the technology.

Some example embodiments of the technology are described in detail below in the following order with reference to the accompanying drawings. Note that the following description is directed to illustrative examples of the technology and not to be construed as limiting to the technology. Factors including, without limitation, numerical values, shapes, materials, components, positions of the components, and how the components are coupled to each other are illustrative only and not to be construed as limiting to the technology. Further, elements in the following example embodiments which are not recited in a most-generic independent claim of the technology are optional and may be provided on an as-needed basis. The drawings are schematic and are not intended to be drawn to scale. Note that the like elements are denoted with the same reference numerals, and any redundant description thereof will not be described in detail.

1. Image Forming Apparatus (First Example Embodiment)

1-1. General Configuration
1-2. Configuration of Developing Unit
1-3. Configuration of Fixing Unit
1-4. Block Configuration
1-5. Configuration of Toner
1-6. Operation
1-7. Workings and Effects 2. Image Forming Apparatus (Second Example Embodiment)

2-1. Configuration
2-2. Operation
2-3. Workings and Effects

3. Image Forming Apparatus (Third Example Embodiment)

3-1. Configuration
3-2. Operation
3-3. Workings and Effects

4. Modification Examples

1. Image Forming Apparatus (First Example Embodiment)

A description is given first of an image forming apparatus according to a first example embodiment of the technology.

The image forming apparatus according to the first example embodiment may form, by the use of a toner, an image on a print medium M which will be described later with reference to FIG. 1, for example. The image forming apparatus according to the first example embodiment may be a so-called full-color printer using an electrophotographic scheme.

The image forming apparatus according to the first example embodiment may employ, as an image formation scheme, an intermediate transfer scheme in particular that forms an image by the use of an intermediate transfer medium. The image forming apparatus employing the intermediate transfer scheme may transfer the toner onto the intermediate transfer medium, and thereafter transfer the toner from the intermediate transfer medium onto the print medium M, in a process of forming the image.

The print medium M is not particularly limited in its material; however, the print medium M may include one or more of materials such as paper and a film, for example.

1-1. General Configuration

A description is given first of a general configuration of the image forming apparatus.

FIG. 1 illustrates an example of a planar configuration of the image forming apparatus. The image forming apparatus may involve conveyance of the print medium M along conveyance routes R1 to R5 in the process of forming the image. Each of the conveyance routes R1 to R5 is illustrated by a dashed line in FIG. 1.

Referring to FIG. 1, the image forming apparatus may include, inside a housing 1, a tray 10, a feeding roller 20, a developing unit 30, a transfer unit 40, a fixing unit 50, conveying rollers 61 to 68, and conveyance path switching guides 69 and 70, for example.

The image forming apparatus may be able to form an image only on one side of the print medium M and also able to form images on both sides of the print medium M, for example.

Hereinafter, when the image forming apparatus forms the image only on one side of the print medium M, the surface on which the image is to be formed is referred to as a "front surface" of the print medium M. Further, a surface, of the print medium M, opposite to the front surface is referred to as a "back surface" of the print medium M. When the image forming apparatus forms the images on both sides of the print medium M, the image is formed on each of the front surface and the back surface of the print medium M.

[Housing]

The housing 1 may include one or more of materials such as a metal material and a polymer material, for example. The housing 1 may be provided with a stacker 2 to which the print medium M provided with a formed image is to be discharged. The print medium M provided with the formed image may be discharged from a discharge opening 1H provided in the housing 1 to the stacker 2.

[Tray and Feeding Roller]

The tray 10 may be attached detachably to the housing 1, for example. The tray 10 may contain the print medium M, for example. The feeding roller 20 may be a cylindrical member that extends in a Y-axis direction and is rotatable around the Y-axis, for example. Each of the members referred to by the name including the term "roller" out of a series of members described below may be a cylindrical member that extends in the Y-axis direction and is rotatable around the Y-axis, as with the feeding roller 20.

The tray 10 may contain a plurality of media M in a stacked state, for example. The media M contained in the tray 10 may be picked out one by one from the tray 10 by the feeding roller 20 for example.

The number of the tray 10 is not particularly limited, and may be only one or two or more. The number of the feeding roller 20 is not particularly limited, and may be only one or two or more. FIG. 1 illustrates an example case in which one tray 10 and one feeding roller 20 are provided.

[Developing Unit]

The developing unit 30 may correspond to a "developing section" in one specific but non-limiting embodiment of the technology. The developing unit 30 may perform a process of attaching the toner to a latent image, i.e., an electrostatic latent image. In other words, the developing unit 30 may perform a developing process. For example, the developing unit 30 may mainly form the electrostatic latent image, and attach the toner to the electrostatic latent image by utilizing Coulomb force.

In this example, the image forming apparatus may include five developing units 30, i.e., developing units 30Y, 30M, 30C, 30K, and 30W.

The developing units 30Y, 30M, 30C, 30K, and 30W each may be attached detachably to the housing 1, and may be disposed along a traveling path of an intermediate transfer belt 41 which will be described later, for example. In this example, the developing units 30Y, 30M, 30C, 30K, and 30W may be disposed in this order from upstream toward downstream in a traveling direction, illustrated by an arrow F5, in which the intermediate transfer belt 41 travels.

The developing units 30Y, 30M, 30C, 30K, and 30W may have configurations similar to each other, except for having toners different in type, e.g., in color, from each other, for example. The toners may each be contained in a cartridge 38 which will be described later referring to FIG. 2, for example.

In one example, the developing unit 30Y may be provided with a yellow toner. The developing unit 30M may be provided with a magenta toner, for example. The developing unit 30C may be provided with a cyan toner, for example. The developing unit 30K may be provided with a black toner, for example. The developing unit 30W may be provided with a white toner, for example. Each of the yellow toner, the magenta toner, the cyan toner, and the black toner may correspond to a "non-metal-containing toner" in one specific but non-limiting embodiment of the technology. The white toner may correspond to a "metal-containing toner" in one specific but non-limiting embodiment of the technology. Accordingly, in this example, the toner may include four types of non-metal-containing toners and one type of metal-containing toner. As used herein, the term "metal-containing toner" as a first toner refers to a toner that includes, as a colorant, one or more of metal materials such as metal and a metal oxide. Non-limiting examples of the metal-containing toner may include the white toner, the brilliant toner (the metallic-color toner), etc. The metal-containing toner may include a metal colorant (a metal pigment), or a colorant of a metal oxide such as a titanium oxide or an aluminum oxide. The term "non-metal-containing toner" as a second toner refers to a toner that includes, as a colorant, one or more of non-metal-based materials such as a pigment and a dye. Non-limiting examples of the non-metal-containing toner may include a red toner, a green toner, a blue toner, a gray toner, or any other chromatic color toner in addition to the yellow toner, the cyan toner, the magenta toner and the black toner.

A configuration of each of the developing units 30Y, 30M, 30C, 30K, and 30W will be described later in greater detail with reference to FIG. 2. A configuration of each of the yellow toner, the magenta toner, the cyan toner, the black toner, and the white toner will be also described later in greater detail.

[Transfer Unit]

The transfer unit 40 may correspond to a "transfer section" in one specific but non-limiting embodiment of the technology. The transfer unit 40 may perform a transfer process by the use of the toner that has been subjected to the developing process by the developing unit 30. For example, the transfer unit 40 may mainly transfer, onto the print medium M, the toner attached to the electrostatic latent image by the developing unit 30.

The transfer unit 40 may include the intermediate transfer belt 41, a driven roller 42, i.e., an idle roller 42, a driving roller 43, a backup roller 44, a primary transfer roller 45, a secondary transfer roller 46, and a cleaning blade 47, for example.

The intermediate transfer belt 41 may correspond to an "intermediate transfer medium" in one specific but non-limiting embodiment of the technology. The intermediate transfer belt 41 may be a medium onto which the toner is temporarily transferred before the toner is transferred onto the print medium M. The intermediate transfer belt 41 may be an elastic endless belt, for example. The intermediate transfer belt 41 may include one or more of polymer materials such as polyimide, for example. The intermediate transfer belt 41 may be able to travel in response to rotation of the driving roller 43, while lying on the driven roller 42, the driving roller 43, and the backup roller 44 in a stretched state.

The driving roller 43 may be rotatable, for example, by means of a belt motor 91 which will be described later with reference to FIG. 4. Each of the driven roller 42 and the backup roller 44 may be rotatable in accordance with the rotation of the driving roller 43, for example.

The primary transfer roller 45 may transfer, onto the intermediate transfer belt 41, the toner attached to the electrostatic latent image. In other words, the primary transfer roller 45 may perform primary transfer. The primary transfer roller 45 may be so pressed against the developing unit 30 as to be in contact with the developing unit 30 with the intermediate transfer belt 41 in between. For example, the primary transfer roller 45 may be so pressed against a photosensitive drum 32 as to be in contact with the photosensitive drum 32 with the intermediate transfer belt 41 in between. The photosensitive drum 32 will be described later in greater detail with reference to FIG. 2. The primary transfer roller 45 may be rotatable, for example, by means of a roller motor 88 which will be described later with reference to FIG. 4.

The number of the provided primary transfer roller 45 is not particularly limited. Therefore, one primary transfer roller 45 may be provided, or two or more primary transfer rollers 45 may be provided. In this example, the transfer unit 40 may include five primary transfer rollers 45, i.e., primary transfer rollers 45Y, 45M, 45C, 45K, and 45W corresponding to the five developing units 30, i.e., the developing units 30Y, 30M, 30C, 30K, and 30W described above. The transfer unit 40 may also include one secondary transfer roller 46 corresponding to the one backup roller 44.

The secondary transfer roller 46 may transfer, onto the print medium M, the toner that has been transferred onto the intermediate transfer belt 41. In other words, the secondary transfer roller 46 may perform secondary transfer. The secondary transfer roller 46 may be so pressed against the backup roller 44 as to be in contact with the backup roller 44. The secondary transfer roller 46 may include a core member and an elastic layer, for example. The core member may include metal, for example. The elastic layer may include a foamed rubber layer that covers an outer peripheral surface of the core member, for example. The secondary transfer roller 46 may be rotatable, for example, by means of the roller motor 88 which will be described later with reference to FIG. 4.

Referring to FIG. 1, the intermediate transfer belt 41 may come into contact with the front surface of the print medium M, and the secondary transfer roller 46 may come into contact with the back surface of the print medium M, in a process of conveyance of the print medium M along the conveyance route R1.

The cleaning blade 47 may be so pressed against the intermediate transfer belt 41 as to be in contact with the intermediate transfer belt 41. The cleaning blade 47 may scrape off unnecessary remains of the toner on the surface of the intermediate transfer belt 41.

[Fixing Unit]

The fixing unit 50 may correspond to a "fixing section" in one specific but non-limiting embodiment of the technology. The fixing unit 50 may perform a fixing process by the use of the toner that has been transferred onto the print medium M by the transfer unit 40. For example, the fixing unit 50 may mainly apply a pressure onto the print medium M onto which the toner has been transferred by the transfer unit 40, while heating the print medium M. The fixing unit 50 may thereby fix the toner to the print medium M.

The fixing unit 50 may switch a temperature at which the fixing process is performed, on the basis of the type of the toner to be used to form an image, in particular. The temperature at which the fixing process is performed may be referred to as a "fixing temperature" hereinafter. The fixing temperature may be a temperature at which the fixing unit 50 fixes, to the print medium M, each of the yellow toner, the magenta toner, the cyan toner, the black toner, and the white toner, for example.

A description will be given later of a configuration and a function of the fixing unit 50 with reference to FIG. 3.

Conveying Roller

Each of the conveying rollers 61 to 68 may include a pair of rollers that face each other with corresponding one of the conveyance routes R1 to R5 in between. Each of the conveying rollers 61 to 68 may convey the print medium M that has been taken out by the feeding rollers 20.

When the image is to be formed only on one side of the print medium M, i.e., only on the front surface of the print medium M, the print medium M may be conveyed by the conveying rollers 61 to 64 along the conveyance routes R1 and R2, for example. When the images are to be formed on both sides of the print medium M, i.e., on both the front surface and the back surface of the print medium M, the print medium M may be conveyed by the conveying rollers 61 to 68 along the conveyance routes R1 to R5, for example.

[Conveyance Path Switching Guide]

The conveyance path switching guides 69 and 70 each may switch a conveyance direction, of the print medium M, in which the print medium M is to be conveyed, depending on conditions such as a manner in which the image is formed on the print medium M. The manner in which the image is formed on the print medium M may include a manner in which the image is to be formed only on one side of the print medium M and a manner in which the images are to be formed on both sides of the print medium M, for example.

1-2. Configuration of Developing Unit

Figure 2:
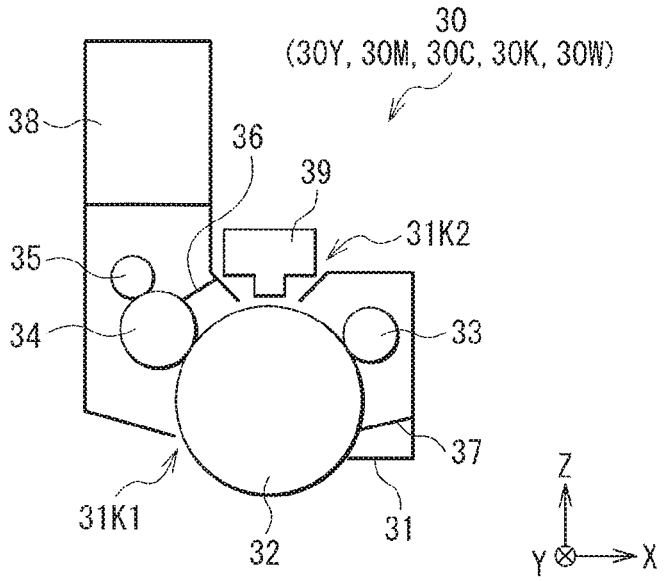
FIG. 2 is an enlarged plan view of an example of a configuration of a developing unit illustrated in FIG. 1.

The configuration of the developing unit 30 is described below FIG. 2 illustrates, in an enlarged fashion, an example of a planar configuration of the developing unit 30, i.e., each of the developing units 30Y, 30M, 30C, 30K, and 30W, illustrated in FIG. 1.

As described above, the developing units 30Y, 30M, 30C, 30K, and 30W may have configurations similar to each other, except for having toners different in type, in color, from each other, for example. The toners may each be contained in the cartridge 38, for example.

Referring to FIG. 2, the developing units 30Y, 30M, 30C, 30K, and 30W each may include the photosensitive drum 32, a charging roller 33, a developing roller 34, a feeding roller 35, a developing blade 36, a cleaning blade 37, the cartridge 38, and a light source 39, for example. It is to be noted that, in one example, the developing unit 30 may not necessarily include the cartridge 38 or the light source 39. In this case, each of the cartridge 38 and the light source 39 may be attached to the developing unit 30 from the outside, for example.

The photosensitive drum 32, the charging roller 33, the developing roller 34, the feeding roller 35, the developing blade 36, and the cleaning blade 37 may be contained inside the housing 31, for example. The cartridge 38 may be attached detachably to the housing 31, for example. The light source 39 may be disposed outside of the housing 31, for example.

The developing units 30Y, 30M, 30C, 30K, and 30W may each be movable between a standby position and a contact position by means of a movement motor 90 which will be described later with reference to FIG. 4, for example. When the photosensitive drum 32 is located at the standby position, the photosensitive drum 32 may be recessed away from the intermediate transfer belt 41. Therefore, the photosensitive drum 32 may not be so pressed against the primary transfer roller 45 as to be in contact with the primary transfer roller 45 with the intermediate transfer belt 41 in between. In contrast, when the photosensitive drum 32 is located at the contact position, the photosensitive drum 32 may be advanced toward the intermediate transfer belt 41. Therefore, the photosensitive drum 32 may be pressed against the primary transfer roller 45 while being applied with a pressure with the intermediate transfer belt 41 in between.

[Housing]

The housing 31 may include one or more of materials such as a metal material and a polymer material, for example. The housing 31 may have an opening 31K1 from which the photosensitive drum 32 is partially exposed, for example. The housing 31 may also have an opening 31K2 that guides light outputted from the light source 39 to the photosensitive drum 32.

[Photosensitive Drum]

The photosensitive drum 32 may mainly serve as a latent image supporting member on which the electrostatic latent image is formed and that supports the electrostatic latent image. The photosensitive drum 32 may extend in the Y-axis direction, and be rotatable around the Y-axis. The photosensitive drum 32 may be an organic photoreceptor that includes a cylindrical electrically-conductive supporting body and a photoconductive layer, for example. The photoconductive layer may cover an outer peripheral surface of the electrically-conductive supporting body. The photosensitive drum 32 may be rotatable by means of a drum motor 89 which will be described later with reference to FIG. 4. The electrically-conductive supporting body may be a metal pipe that includes one or more of metal materials such as aluminum, for example. The photoconductive layer may be a stack that includes an electric charge generating layer and an electric charge transfer layer, for example. Part of the photosensitive drum 32 may be exposed from the opening 31K1 provided in the housing 31.

[Charging Roller]

The charging roller 33 may mainly electrically charge a surface of the photosensitive drum 32. The charging roller 33 may include a metal shaft and an electrically-semiconductive epichlorohydrin rubber layer that covers an outer peripheral surface of the metal shaft, for example. The charging roller 33 may be so pressed against the photosensitive drum 32 as to be in contact with the photosensitive drum 32.

[Developing Roller]

The developing roller 34 may mainly support the toner that is fed from the feeding roller 35, and mainly attach the fed toner onto the electrostatic latent image formed on the surface of the photosensitive drum 32. The developing roller 34 may include a metal shaft and an electrically-semiconductive urethane rubber layer that covers an outer peripheral surface of the metal shaft, for example. The developing roller 34 may be so pressed against the photosensitive drum 32 as to be in contact with the photosensitive drum 32.

[Feeding Roller]

The feeding roller 35 may mainly feed the toner to the surface of the developing roller 34. The feeding roller 35 may include a metal shaft and an electrically-semiconductive foamed silicon sponge layer that covers an outer peripheral surface of the metal shaft, for example. The feeding roller 35 may be a so-called sponge roller, for example. The feeding roller 35 may be so pressed against the developing roller 34 as to be in contact with the developing roller 34.

[Developing Blade]

The developing blade 36 may mainly control the thickness of the toner fed to the surface of the developing roller 34. The developing blade 36 may be disposed at a position away from the developing roller 34 with a predetermined distance, i.e., predetermined spacing, in between, for example. The thickness of the toner may be controlled on the basis of the distance, i.e., the spacing, between the developing roller 34 and the developing blade 36. The developing blade 36 may include one or more of metal materials such as stainless steel, for example.

[Cleaning Blade]

The cleaning blade 37 may be a plate-like elastic member that mainly scrapes off unnecessary remains of the toner that are present on the surface of the photosensitive drum 32. The cleaning blade 37 may extend in a direction substantially parallel to a direction in which the photosensitive drum 32 extends, for example. The cleaning blade 37 may be so pressed against the photosensitive drum 32 as to be in contact with the photosensitive drum 32. The cleaning blade 37 may include one or more of polymer materials such as urethane rubber, for example.

[Cartridge]

The cartridge 38 may be a container that mainly contains the toner. The type, e.g., the color, of the toner contained in the cartridge 38 may be as follows, for example. The cartridge 38 of the developing unit 30Y may contain the yellow toner, for example. The cartridge 38 of the developing unit 30M may contain the magenta toner, for example. The cartridge 38 of the developing unit 30C may contain the cyan toner, for example. The cartridge 38 of the developing unit 30K may contain the black toner, for example. The cartridge 38 of the developing unit 30W may contain the white toner, for example,

[Light Source]

The light source 39 may be an exposure device that mainly exposure the surface of the photosensitive drum 32 to thereby form the electrostatic latent image on the surface of the photosensitive drum 32. The light source 39 may be, for example, a light-emitting diode (LED) head, and include components such as an LED element and a lens array. The LED element and the lens array may be so disposed that the light outputted from the LED element forms an image on the surface of the photosensitive drum 32, for example.

1-3. Configuration of Fixing Unit

A description is given next of a detailed configuration of the fixing unit 50. FIG. 3 illustrates an example of a detailed planar configuration of the fixing unit 50 illustrated in FIG. 1.

Figure 3:
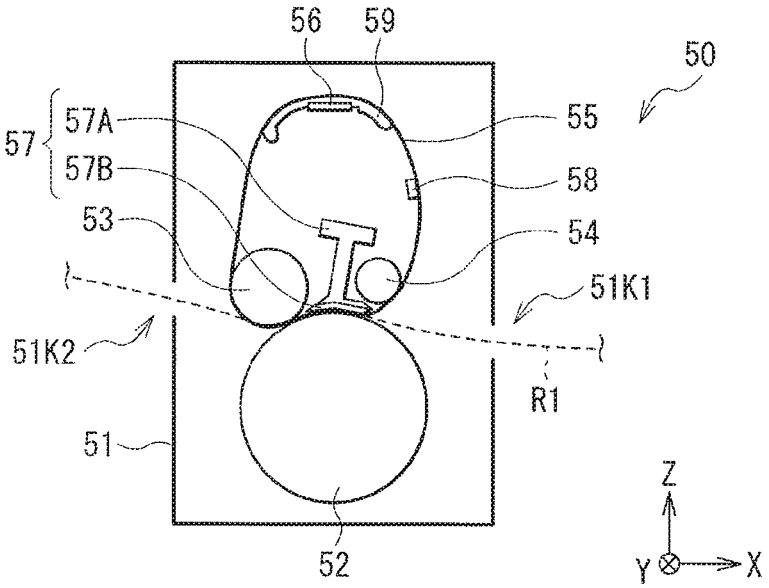
FIG. 3 is a plan view of an example of a detailed configuration of a fixing unit illustrated in FIG. 1.

Referring to FIG. 3, the fixing unit 50 may include, inside a housing 51, a pressure applying roller 52, a fixing roller 53, a guiding roller 54, a fixing belt 55, a heater 56, a pressure applying pad 57, and a heating thermistor 58, for example.

[Housing]

The housing 51 may include one or more of materials such as a metal material and a polymer material, for example. The housing 51 may have an opening 51K1 that guides the print medium M into the housing 51, for example. The housing 51 may also have an opening 51K2 that guides the print medium M to outside of the housing 51.

[Pressure Applying Roller]

The pressure applying roller 52 may mainly apply a pressure onto the print medium M onto which the toner has been transferred. The pressure applying roller 52 may be so pressed against the fixing roller 53 as to be in contact with the fixing roller 53 with the fixing belt 55 in between.

For example, referring to FIGS. 1 and 3, the pressure applying roller 52 may be disposed on side, of the conveyance route R1 illustrated in FIG. 1, on which the secondary transfer roller 46 is disposed. In other words, the pressure applying roller 52 may be disposed on side, of the intermediate transfer belt 41, opposite to the side on which the print medium M comes into contact with the intermediate transfer belt 41, i.e., on lower side of the conveyance route R1, and face the fixing belt 55. Therefore, the pressure applying roller 52 may come into contact with the back surface of the print medium M in a process of the conveyance of the print medium M along the conveyance route R1.

The pressure applying roller 52 may include a hollow cylindrical metal core, and a resin coating formed on a surface of the metal core, for example. The metal core may include one or more of metal materials such as iron, for example. The resin coating may include one or more of polymer materials such as foamed silicon rubber, a copolymer of tetrafluoroethylene and perfluoroalkylvinylether (PFA), and polytetrafluoroethylene (PTFE), for example.

[Fixing Roller]

The fixing roller 53 may mainly apply a pressure, together with the pressure applying roller 52, onto the print medium M onto which the toner has been transferred. The fixing roller 53 may be disposed downstream of the pressure applying pad 57 in a direction in which the fixing belt 55 travels, for example. Further, the fixing roller 53 may be rotatable by means of a fixing motor 92 which will be described later with reference to FIG. 4, for example.

For example, referring to FIGS. 1 and 3, the fixing roller 53 may be disposed on side, of the conveyance route R1, on which the backup roller 44 is disposed. In other words, the fixing roller 53 may be disposed on side, of the intermediate transfer belt 41, on which the print medium M comes into contact with the intermediate transfer belt 41, i.e., on upper side of the conveyance route R1. Therefore, the fixing roller 53 may face the pressure applying roller 52 with the fixing belt 55 in between.

The fixing roller 53 may have a configuration similar to that of the pressure applying roller 52, for example. However, in one alternative example, the fixing roller 53 may have a configuration different from that of the pressure applying roller 52,

[Guiding Roller]

The guiding roller 54 may mainly so guide the fixing belt 55 that the fixing belt 55 travel between the pressure applying roller 52 and the pressure applying pad 57. The guiding roller 54 may be disposed upstream of the pressure applying pad 57 in the direction in which the fixing belt 55 travels, for example. It is to be noted that the guiding roller 54 may be disposed on side, of the intermediate transfer belt 41, on which the print medium M comes into contact with the intermediate transfer belt 41, as with the fixing roller 53.

The guiding roller 54 may have a configuration similar to that of the pressure applying roller 52, for example. However, in one alternative example, the guiding roller 54 may have a configuration different from that of the pressure applying roller 52.

[Fixing Belt]

The fixing belt 55 may mainly heat the print medium M onto which the toner has been transferred. The fixing belt 55 may be an endless belt, for example. Accordingly, the fixing belt 55 may be able to travel in accordance with the rotation of the fixing roller 53, while lying on the components such as the fixing roller 53, the guiding roller 54, and a holder 59 which will be described later, in a stretched state, for example. The components such as the fixing roller 53, the guiding roller 54, and the holder 59 may be disposed inside space surrounded by the fixing belt 55, for example. The pressure applying roller 52 may be disposed outside the space surrounded by the fixing belt 55, for example.

The fixing belt 55 may be so disposed as to be able to travel along part of the conveyance route R1. In other words, the fixing belt 55 may be so disposed as to be able to travel between the pressure applying roller 52 and the fixing roller 53. Therefore, the pressure applying roller 52 and the fixing roller 53 may face each other with the fixing belt 55 in between. Referring to FIGS. 1 and 3, the fixing belt 55 may be disposed on side, of the conveyance route R1, on which the backup roller 44 is disposed. In other words, the fixing belt 55 may be disposed on side, of the intermediate transfer belt 41, on which the print medium M comes into contact with the intermediate transfer belt 41, i.e., on the upper side of the conveyance route R1.

As described above, the pressure applying roller 52 may be so pressed against the fixing roller 53 as to be in contact with the fixing roller 53 with the fixing belt 55 in between. Therefore, the fixing belt 55 heated by the heater 56 may be able to be heated, while the print medium M onto which the toner has been transferred is applied with the pressure by the pressure applying roller 52.

The fixing belt 55 may include a belt and a rubber layer provided on a surface of the belt, for example. The belt may include one or more of polymer materials such as polyimide, for example. The rubber layer may include one or more of polymer materials such as silicon rubber. The belt may be provided on the inner side of the fixing belt 55, i.e., side of the fixing belt 55 closer to the fixing roller 53, for example. The rubber layer may be disposed on the outer side of the fixing belt 55, i.e., side of the fixing belt 55 farther from the fixing roller 53, for example.

[Heater]

The heater 56 may mainly heat the fixing belt 55. The heater 56 may include a halogen lamp, for example.

The heater 56 may be supported by the holder 59, for example. The heater 56 may be biased toward the fixing belt 55, for example. The holder 59 may be so provided as to extend downstream of the heater 56 in the direction in which the fixing belt 55 travels, and may be also so provided as to extend upstream of the heater 56 in the direction in which the fixing belt 55 travels, for example.

The heater 56 is not particularly limited in its position as long as the h eater 56 is disposed at a position that is located upstream of the pressure applying pad 57, in the direction in which the fixing belt 55 travels.

[Pressure Applying Pad]

The pressure applying pad 57 may mainly press the fixing belt 55 toward the pressure applying roller 52 while applying a pressure onto the fixing belt 55. This may bring the fixing belt 55 into contact with the print medium M onto which the toner has been transferred. This allows the fixing belt 55 to heat the print medium M.

The pressure applying pad 57 may be disposed between the fixing roller 53 and the guiding roller 54 in the direction in which the fixing belt 55 travels, for example. Further, the pressure applying pad 57 may be movable between a standby position and a pressing position, for example. When the pressure applying pad 57 is located at the standby position, the pressure applying pad 57 may be recessed away from the pressure applying roller 52. Therefore, the pressure applying pad 57 may not be pressed against the pressure applying roller 52 while being applied with the pressure with the fixing belt 55 in between. In contrast, when the pressure applying pad 57 is located at the pressing position, the pressure applying pad 57 may be advanced toward the pressure applying roller 52. Therefore, the pressure applying pad 57 may be pressed against the pressure applying roller 52 while being applied with the pressure with the fixing belt 55 in between.

When the fixing unit 50 does not perform the fixing process, the pressure applying pad 57 may be located at the standby position, for example. In contrast, when the fixing unit 50 performs the fixing process, the pressure applying pad 57 may move from the standby position to the pressing position, for example. When the fixing unit 50 completes the fixing process, the pressure applying pad 57 may be returned from the pressing position to the standby position, for example.

The pressure applying pad 57 may be disposed inside the space surrounded by the fixing belt 55, as with the fixing roller 53, for example. Therefore, when the pressure applying pad 57 moves to the pressing position, the fixing belt 55 may lie also on the pressure applying pad 57 in a stretched state, for example.

The pressure applying pad 57 may extend in a direction similar to a direction in which the pressure applying roller 52 extends, i.e., the Y-axis direction, for example. Further, the pressure applying pad 57 may include a frame unit 57A, and a pad unit 57B attached to the frame unit 57A, for example.

The frame unit 57A may be disposed farther from the fixing belt 55 than the pad unit 57B, for example. The frame unit 57A may include one or more of metal materials such as aluminum, for example. The pad unit 57B may be disposed closer to the fixing belt 55 than the frame unit 57A, for example. The pad unit 57B may include one or more of polymer materials such as silicon rubber, for example. Accordingly, when the pressure applying pad 57 moves to the pressing position, the pad unit 57B may come into contact with the fixing belt 55, for example. The pad unit 57B may have a surface that is curved along the surface of the pressure applying roller 52, for example.

[Heating Thermistor]

The heating thermistor 58 may mainly measure a surface temperature of the fixing belt 55. The heating thermistor 58 may measure a temperature at the time when the fixing unit 50 performs the fixing process, and the so-called fixing temperature.

The heating thermistor 58 is not particularly limited in its position, as long as the heating thermistor 58 is located at the position is able to measure the surface temperature of the fixing belt 55. In one example, the heating thermistor 58 may be disposed inside the space surrounded by the fixing belt 55, and between the guiding roller 54 and the heater 56 in the direction in which the fixing belt 55 travels.

1-4. Block Configuration

A description is given next of a block configuration of the image forming apparatus.

Figure 4:
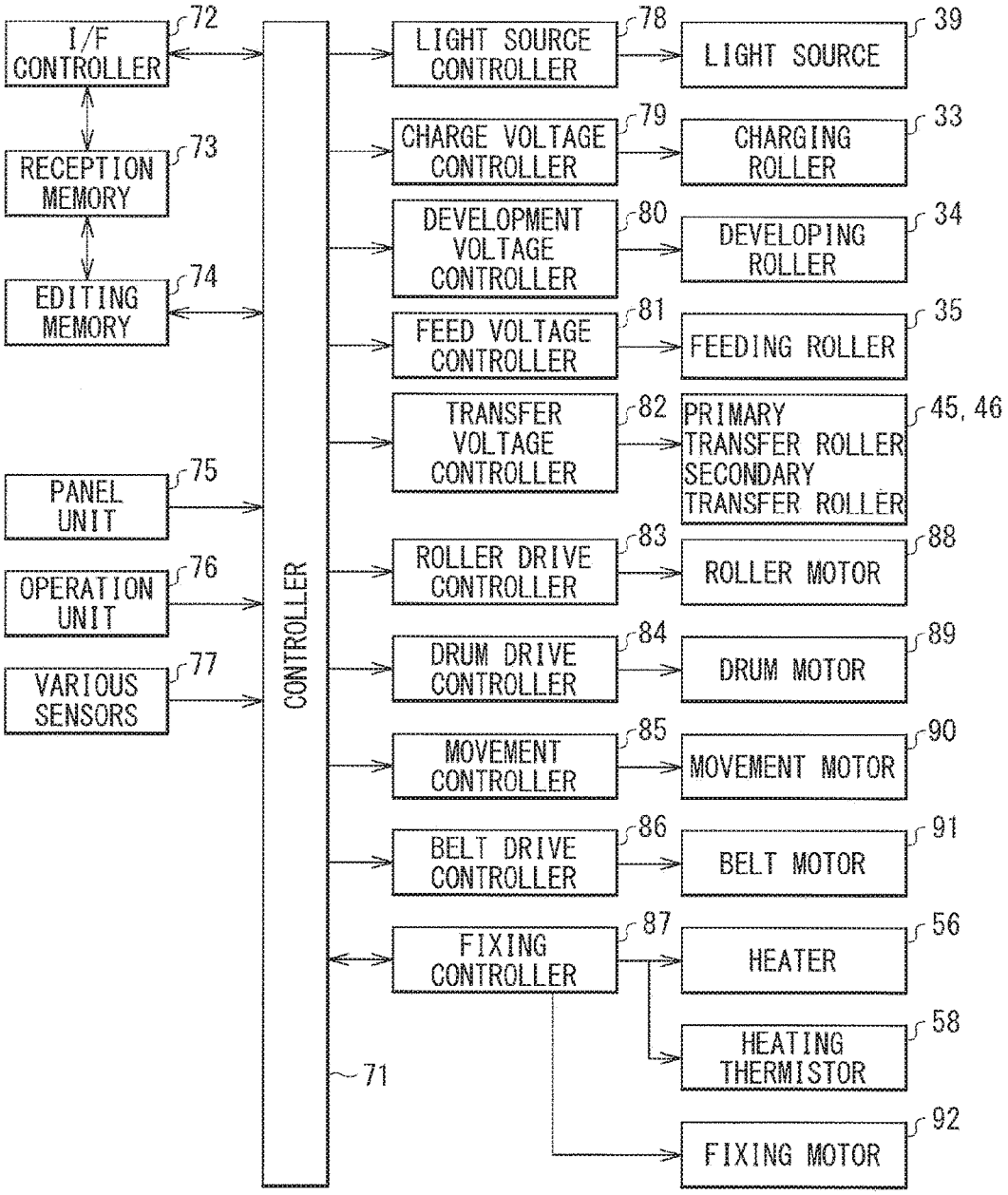
FIG. 4 is a block diagram illustrating an example of the configuration of the image forming apparatus according to the first example embodiment.

FIG. 4 illustrates an example of the block configuration of the image forming apparatus, and includes together part of the components of the image forming apparatus that have been already described.

Referring to FIG. 4, the image forming apparatus may include a controller 71, an interface (I/F) controller 72, a reception memory 73, an editing memory 74, a panel unit 75, an operation unit 76, various sensors 77, a light source controller 78, a charge voltage controller 79, a development voltage controller 80, a feed voltage controller 81, a transfer voltage controller 82, a roller drive controller 83, a drum drive controller 84, a movement controller 85, a belt drive controller 86, and a fixing controller 87, for example.

The controller 71 may mainly control an operation of the image forming apparatus as a whole. The controller 71 may include a control circuit, a memory, an input-output port, a timer, and any other suitable component, for example. The control circuit may include a central processing unit (CPU) and any other suitable component, for example. The memory may include one or more of storage devices such as a read-only memory (ROM) and a random access memory (RAM), for example.

The I/F controller 72 may mainly receive information such as data transmitted from an external device to the image forming apparatus. The external device may be a personal computer that is usable by a user of the image forming apparatus or any other device, for example. The information transmitted from the external device to the image forming apparatus may be image data directed to formation of the image, for example.

The reception memory 73 may mainly store information such as data received by the image forming apparatus. The editing memory 74 may mainly store data including the image data that has been stored in the reception memory 73 and subjected to an editing process, or any other suitable data.

The panel unit 75 may include a display panel or any other suitable component, for example. The display panel may display information necessary for the user to operate the image forming apparatus. The display panel is not particularly limited in its type; however, the display panel may be a liquid crystal panel or any other suitable panel, for example. The operation unit 76 may include a button that is to be operated by the user upon the operation of the image forming apparatus, or any other suitable component, for example.

The various sensors 77 may include one or more of sensors such as a temperature sensor, a humidity sensor, an image concentration sensor, a medium position detector, a toner left amount detector, and a motion detector, for example.

The light source controller 78 may mainly control an exposure operation of the light source 39 or any other operation, for example. The charge voltage controller 79 may mainly control a voltage to be applied to the charging roller 33 or any other voltage, for example. The development voltage controller 80 may mainly control a voltage to be applied to the developing roller 34 or any other voltage, for example. The feed voltage controller 81 may mainly control a voltage to be applied to the feeding roller 35 or any other voltage, for example. The transfer voltage controller 82 may mainly control a voltage to be applied to each of the primary transfer roller 45 and the secondary transfer roller 46, or any other voltage, for example. The foregoing voltages may each be settable in accordance with an instruction given by the controller 71, and may each be variable to any voltage in accordance with the instruction given by the controller 71.

FIG. 4 simplifies the content of the illustration; however, in one example, the image forming apparatus may include five light source controllers 78 corresponding to the five developing units 30, i.e., the developing units 30Y, 30M, 30C, 30K, and 30W. In one example, the five light source controllers 78 may be the light source controller 78 that controls the light source 39 mounted on the developing unit 30Y, the light source controller 78 that controls the light source 39 mounted on the developing unit 30M, the light source controller 78 that controls the light source 39 mounted on the developing unit 30C, the light source controller 78 that controls the light source 39 mounted on the developing unit 30K, and the light source controller 78 that controls the light source 39 mounted on the developing unit 30W.

The description above regarding the light source controller 78 may be similarly applicable to each of the charge voltage controller 79, the development voltage controller 80, the feed voltage controller 81, and the transfer voltage controller 82, for example. In one example, the image forming apparatus may include, corresponding to the five developing units 30, the five charge voltage controller 79, the five development voltage controllers 80, the five feed voltage controllers 81, and the five transfer voltage controllers 82, for example.

The roller drive controller 83 may mainly control rotation operations of a series of rollers or any other operation by means of the roller motor 88, for example. The series of rollers may include the charging roller 33, the developing roller 34, the feeding roller 35, the primary transfer roller 45, and the secondary transfer roller 46. The drum drive controller 84 may mainly control a rotation operation of the photosensitive drum 32 or any other operation by means of the drum motor 89, for example. The movement controller 85 may mainly control a moving operation of the developing unit 30 or any other operation by means of the movement motor 90, for example. The belt drive controller 86 may mainly control a moving operation of the intermediate transfer belt 41 or any other operation by means of the belt motor 91, for example. The fixing controller 87 may mainly control an operation of the heater 56 on the basis of a heating temperature TH measured by the heating thermistor 58. The heating temperature TH is a surface temperature of the fixing belt 55 and may determine the foregoing fixing temperature. Further, the fixing controller 87 may also mainly control a rotation operation of the fixing roller 53 or any other operation by means of the fixing motor 92, for example.

The description above regarding the light source controller 78 may be similarly applicable to each of the roller drive controller 83, the drum drive controller 84, and the movement controller 85, for example. In one example, the image forming apparatus may include, corresponding to the five developing units 30, the five roller drive controllers 83, the five drum drive controllers 84, and the five movement controllers 85, for example.

In one example, the fixing controller 87 may switch the fixing temperature on the basis of the type of the toner used in the formation of the image as described above.

For example, when the white toner is not transferred onto the print medium M, and one or more of the yellow toner, the magenta toner, the cyan toner, and the black toner are transferred onto the print medium M, the fixing controller 87 may set the heating temperature TH to be a relatively-high temperature T1, thereby causing the fixing process to be performed at the relatively-high fixing temperature, in which case the heating temperature TH equals the relatively-high temperature T1, i.e., TH=T1.

In contrast, when the white toner is transferred onto the print medium M, the fixing controller 87 may set the heating temperature TH to be a relatively-low temperature T2, thereby causing the fixing process to be performed at the relatively-low fixing temperature T2, in which case the heating temperature TH equals the relatively-low temperature T2, i.e., TH=T2. The relatively-low temperature T2 may be lower than the relatively-high temperature T1, i.e., T2 T1. In such a manner, the fixing controller 87 may set the fixing temperature in a case where the white toner is used to be lower than the fixing temperature in a case where the white toner is not used.

A detailed description will be given later with reference to FIG. 5 of an operation of switching the fixing temperature on the basis of the type of the toner.

1-5. Configuration of Toner

A description is given next of a configuration of the toner.

The toner described below may be a negatively-charged toner of a single component development method, for example. In other words, the toner may have a negative charging polarity, for example.

The single component development method provides the toner itself with an appropriate amount of electric charge without using a carrier, i.e., a magnetic particle, to apply an electric charge to the toner. In contrast, a two component development method provides the toner with an appropriate amount of electric charge by utilizing friction between the foregoing carrier and the toner owing to mixing of the foregoing carrier and the toner.

A method of manufacturing the toner is not particularly limited. Specific but non-limiting examples of the method of manufacturing the toner may include pulverization and polymerization. Two or more of the foregoing methods may be used in any combination. Non-limiting examples of the polymerization may include an emulsion polymerization aggregation method and a solution suspension method.

The toner may include the five types of toners, i.e., the five colors of toners, as described above, for example. In one example, the five types of toners may include the yellow toner, the magenta toner, the cyan toner, the black toner, and the white toner.

[Yellow Toner, Magenta Toner, Cryan Toner, and Black Toner]

The yellow toner may be the non-metal-containing toner, as described above. The yellow toner may therefore include, as a colorant, one or more of the non-metal materials such as the pigment and the dye.

For example, the yellow toner may include a yellow colorant, binder resin, an external additive, a release agent, an electric charge control agent, and any other agent. The yellow colorant may include one or more of yellow pigments, for example. Non-limiting examples of the yellow pigment may include Pigment Yellow 74.

The yellow toner may further include one or more of other materials such as an electric conductivity modifier, a reinforcement filler, an antioxidant, an antistaling agent, a flow improver, and a cleaning improver, for example.

The magenta toner may have a configuration similar to that of the yellow toner except that the magenta toner includes a magenta colorant in place of the yellow colorant, for example. The magenta colorant may include one or more of magenta pigments, for example. Non-limiting examples of the magenta pigment may include Pigment Red 122 and quinacridone.

The cyan toner may have a configuration similar to that of the yellow toner except that the cyan toner includes a cyan colorant in place of the yellow colorant, for example. The cyan colorant may include one or more of cyan pigments, for example. Non-limiting examples of the cyan pigment may include Copper Pigment Blue 15:3 and phthalocyanine.

The black toner may have a configuration similar to that of the yellow toner except that the black toner includes a black colorant in place of the yellow colorant, for example. The black colorant may include one or more of black pigments, for example. Non-limiting examples of the black pigment may include carbon black.

The binder resin may mainly bind materials such as the colorant with each other. The binder resin may include one or more of polymer compounds such as polyester-based resin, styrene-acrylic resin, epoxy resin, and styrene-butadiene-based resin.

The external additive may mainly suppress a phenomenon such as aggregation in the toner, and thereby improve fluidity of the toner. The external additive may include one or more of materials such as an inorganic material and an organic material, for example. Non-limiting examples of the inorganic material may include hydrophobic silica. Non-limiting examples of the organic material may include melamine resin.

The release agent may mainly improve characteristics, of the toner, such as fixing characteristics and offset resistance. The release agent may include one or more of waxes such as aliphatic-hydrocarbon-based wax, an oxide of aliphatic-hydrocarbon-based wax, fatty-acid-ester-based wax, and a deoxide of fatty-acid-ester-based wax. Other than the waxes described above, the release agent may also be a block copolymer of any of the foregoing series of waxes, for example.

Non-limiting examples of the aliphatic-hydrocarbon-based wax may include low-molecular polyethylene, low-molecular polypropylene, a copolymer of olefin, microcrystalline wax, paraffin wax, and Fischer-Tropsch wax. Non-limiting examples of the oxide of aliphatic-hydrocarbon-based wax may include oxidized polyethylene wax. Non-limiting examples of the fatty-acid-ester-based wax may include carnauba wax and montanic acid ester wax. The deoxide of fatty-acid-ester-based wax may be partially-deoxidized or fully-deoxidized fatty-acid-ester-based wax. Non-limiting examples of the deoxide of fatty-acid-ester-based wax may include deoxidized carnauba wax.

The electric charge control agent may mainly control characteristics such as triboelectric charging characteristics of the toner. The electric charge control agent to be used for the negatively-charged toner may include one or more of materials such as an azo-based complex, a salicylic-acid-based complex, and a calixarene-based complex, for example. In one example where the styrene-acrylic resin is used as the binder resin, the electric charge control agent may not be necessarily used.

The yellow toner, the magenta toner, the cyan toner, and the black toner that are the non-metal-containing toners may each have electric charge characteristics higher than those of the white toner that is the metal-containing toner. The electric charge characteristics described below may be negative electric charge characteristics as described above, for example. Accordingly, an absolute value of the electric charge amount (μC/g) of each of the yellow toner, the magenta toner, the cyan toner, and the black toner may be sufficiently greater than an absolute value of the electric charge amount (μC/g) of the white toner.

[White Toner]

The white toner may be the metal-containing toner, as described above. The white toner may therefore include, as a colorant, one or more of the metal materials such as the metal and the metal oxide.

The white toner may have a configuration similar to that of the yellow toner except that the white toner includes a white colorant in place of the yellow colorant and includes binder resin different in type from the binder resin included in the yellow toner, for example. The white colorant may include one or more of materials such as an titanium oxide, for example.

The white toner that is the metal-containing toner may have electric charge characteristics lower than those of each of the yellow toner, the magenta toner, the cyan toner, and the black toner that are the non-metal-containing toners. Accordingly, the absolute value of the electric charge amount (μC/g) of the white toner may be sufficiently smaller than the absolute value of the electric charge amount (μC/g) of each of the yellow toner, the magenta toner, the cyan toner, and the black toner. In other words, the white toner may be a so-called low electric-charge toner.

The binder resin may include one or more of polymer compounds such as polyester-based resin. One reason for this is that the polyester-based resin has high affinity for the print medium M such as paper, and the toner including the polyester-based resin as the binder resin is therefore easily fixed to the print medium M. Another reason is that the polyester-based resin has high physical strength even with a relatively-small molecular weight, and the toner including the polyester-based resin as the binder resin therefore has high durability. Still another reason is that the toner is fixed to the print medium M more easily even when the toner has low electric charge characteristics.

The polyester-based resin is not particularly limited in its crystalline state. Therefore, the polyester-based resin may be crystalline polyester, amorphous polyester, or both. In one example, the polyester-based resin may be the crystalline polyester. One reason for this is that the toner is thereby fixed to the print medium M more easily, and the durability of the toner is thereby improved.

The polyester-based resin may be a reactant (a condensation polymer) of one or more alcohols and one or more carboxylic acids, for example.

The type of the alcohol is not particularly limited. In one example, the alcohol may be an alcohol having a valence of two or greater or a derivative thereof. Non-limiting examples of the alcohol having the valence of two or greater may include ethylene glycol, diethylene glycol, triethylene polyethylene glycol, propylene glycol, butanediol, pentanediol, hexanediol, cyclohexanedimethanol, xylene glycol, dipropylene glycol, polypropylene glycol, bisphenol A, hydrogenated bisphenol A, bisphenol A ethylene oxide, bisphenol A propylene oxide, sorbitol, and glycerin.

The type of the carboxylic acid is not particularly limited. In one example, however, the carboxylic acid may be a carboxylic acid having a valence of two or greater or a derivative thereof. Non-limiting examples of the carboxylic acid having the valence of two or greater may include maleic acid, furnaric acid, phthalic acid, isophthalic acid, terephthalic acid, succinic acid, adipic acid, tritnellitic acid, pyromellitic acid, cyclopentane dicarboxylic acid, succinic anhydride, trimellitic anhydride, maleic anhydride, and dodecenylsuccinic anhydride.

1-6. Operation

A description is given next of an operation of the image forming apparatus.

A description is given of an operation of forming an image, and a description is given thereafter of an operation of switching the fixing temperature on the basis of the type of the toner, referring to FIGS. 1 to 4 where appropriate.

[Image Forming Operation]

In a case of forming an image on the print medium M, the image forming apparatus may perform a developing process, a primary transfer process, a secondary transfer process, and the fixing process in this order, and may perform a cleaning process on an as-needed basis, as described below, for example.

[Developing Process]

First, the print medium M contained in the tray 10 may be picked up by the feeding roller 20. The print medium M picked up by the feeding roller 20 may be conveyed by the conveying rollers 61 and 62 along the conveyance route R1 in a direction indicated by an arrow F1.

The developing process may involve the operation performed in the developing unit 30Y as described below. In the developing unit 30Y, the charging roller 33 may apply a direct-current voltage to the surface of the photosensitive drum 32 while rotating in accordance with the rotation of the photosensitive drum 32. The surface of the photosensitive drum 32 may be thereby charged evenly.

Thereafter, the light source 39 may apply light to the surface of the photosensitive drum 32 on the basis of the image data that has been subjected to the editing process. A surface potential in a part, of the surface of the photosensitive drum 32, on which the light is applied is thereby attenuated. An electrostatic latent image may be thus formed on the surface of the photosensitive drum 32.

In the developing unit 30Y, the yellow toner contained in the cartridge 38 may be released toward the feeding roller 35.

The feeding roller 35 may rotate after receiving application of a voltage. The yellow toner may be thus fed from the cartridge 38 to the surface of the feeding roller 35.

The developing roller 34 may rotate while being so pressed against the feeding roller 35 as to be in contact with the feeding roller 35, after receiving application of a voltage. The yellow toner fed to the surface of the feeding roller 35 may be thereby adsorbed onto the surface of the developing roller 34, whereby the yellow toner may be conveyed by utilizing the rotation of the developing roller 34. In this case, the yellow toner adsorbed onto the surface of the developing roller 34 may be partially removed by the developing blade 36, whereby the yellow toner adsorbed onto the surface of the developing roller 34 may be caused to have an even thickness.

After the photosensitive drum 32 rotates while being so pressed against the developing roller 34 as to be in contact with the developing roller 34, the yellow toner adsorbed onto the surface of the developing roller 34 may be moved onto the surface of the photosensitive drum 32. The yellow toner may be thereby attached to the surface of the photosensitive drum 32, i.e., to the electrostatic latent image.

[Primary Transfer Process]

In the transfer unit 40, when the driving roller 43 rotates, the driven roller 42 and the backup roller 44 may rotate in accordance with the rotation of the driving roller 43. This may cause the intermediate transfer belt 41 to travel in a direction indicated by an arrow F5.

The primary transfer process may involve application of a voltage to the primary transfer roller 45Y. The primary transfer roller 45Y may be so pressed against the photosensitive drum 32 as to be in contact with the photosensitive drum 32 with the intermediate transfer belt 41 in between. Hence, the yellow toner that has been attached to the surface, i.e., to the electrostatic latent image, of the photosensitive drum 32 in the foregoing developing process may be transferred onto the intermediate transfer belt 41.

Thereafter, the intermediate transfer belt 41 onto which the yellow toner has been transferred may continue to travel in the direction indicated by the arrow F5. This may allow each of the set of the developing unit 30M and the primary transfer roller 45M, the set of the developing unit 30C and the primary transfer roller 45C, the set of the developing unit 30K and the primary transfer roller 45K, and the set of the developing unit 30W and the primary transfer roller 45W, to perform the developing process and the primary transfer process by a procedure similar to the foregoing procedure performed by the developing unit 30Y and the primary transfer roller 45Y. Thereby, the magenta toner, the cyan toner, the black toner, and the white toner may be transferred onto the surface of the intermediate transfer belt 41.

In one example, the developing unit 30M and the primary transfer roller 45M may transfer the magenta toner onto the surface of the intermediate transfer belt 41. The developing unit 30C and the primary transfer roller 45C may transfer the cyan toner onto the surface of the intermediate transfer belt 41. The developing unit 30K and the primary transfer roller 45K may transfer the black toner onto the surface of the intermediate transfer belt 41. The developing unit 30W and the primary transfer roller 45W may transfer the white toner onto the surface of the intermediate transfer belt 41.

It is to be noted that whether each of the developing process and the primary transfer process is actually performed by the respective developing units 30Y, 30M, 30C, 30K, and 30W and the primary transfer rollers 45Y, 45M, 45C, 45K, and 45W may be determined depending on the color or the combination of colors that is necessary for the formation of the image.

[Secondary Transfer Process]

The print medium M may pass between the backup roller 44 and the secondary transfer roller 46 upon being conveyed along the conveyance route R1.

The secondary transfer process may involve application of a voltage to the secondary transfer roller 46. The secondary transfer roller 46 may be so pressed against the backup roller 44 as to be in contact with the backup roller 44 with the print medium M in between. Hence, the toner that has been transferred onto the intermediate transfer belt 41 in the foregoing primary transfer process may be transferred onto the print medium M.

[Fixing Process]

After the toner has been transferred onto the print medium M in the secondary transfer process, the print medium M may be continuously conveyed along the conveyance route R1 in the direction indicated by the arrow F1. The print medium M may be thus conveyed to the fixing unit 50.

The fixing process may involve, addressing the control of the fixing temperature, heating of the fixing belt 55 by the heater 56, and a control that is so performed as to cause the surface temperature of the fixing belt 55, i.e., the heating temperature TH, to be a desired temperature. The heating temperature TH may be measured by the heating thermistor 58.

When the fixing roller 53 rotates while being so pressed against the pressure applying roller 52 as to be in contact with the pressure applying roller 52 with the fixing belt 55 in between, the fixing belt 55 may so travel as to pass between the pressure applying roller 52 and the fixing roller 53, and the print medium M may be so conveyed as to pass between the pressure applying roller 52 and the fixing belt 55.

In this case, the pressure applying pad 57 may be moved from the standby position to the pressing position. Therefore, the fixing belt 55 may be pressed, by the pressure applying pad 57, against the pressure applying roller 52 while being applied with a pressure with the print medium M in between. The toner that has been transferred onto the surface of the print medium M may be thereby heated, which may cause the toner to be molten. Further, the molten toner may be so pressed against the print medium M while being applied with a pressure. This may cause the toner to be firmly attached to the print medium M.

As a result, the toner may be fixed to the print medium M, resulting in formation of the image.

The print medium M on which the image has been formed may be conveyed by the conveying rollers 63 and 64 along the conveyance route R2 in a direction indicated by an arrow F2. The print medium M may thus be discharged from the discharge opening 1H to the stacker 2.

It is to be noted that the procedure of conveying the print medium M may be varied in accordance with the manner by which the image is to be formed on the surface of the print medium M.

For example, in a case where images are to be formed on both sides of the print medium M, the print medium M that has passed the fixing unit 50 may be conveyed by the conveying rollers 65 to 68 along the conveyance routes R3 to R5 in directions indicated by respective arrows F3 and F4, and be thereafter conveyed again by the conveying rollers 61 and 62 along the conveyance route R1 in the direction indicated by the arrow F1. In this case, the direction in which the print medium M is to be conveyed may be controlled by the conveyance path switching guides 69 and 70. This may allow the back surface of the print medium M, i.e., the surface on which no image has been formed yet, to be subjected to the developing process, the primary transfer process, the secondary transfer process, and the fixing process.

[Cleaning Process]

Unnecessary remains of the toner may sometimes be present on the surface of the photosensitive drum 32 in the developing unit 30. The unnecessary remains of the toner may be part of the toner that has been used in the primary transfer process, which may be the toner that has remained on the surface of the photosensitive drum 32 without being transferred onto the intermediate transfer belt 41, for example.

To address this, the photosensitive drum 32 may rotate while being so pressed against the cleaning blade 37 as to be in contact with the cleaning blade 37 in the developing unit 30. This may cause the remains of the toner present on the surface of the photosensitive drum 32 to be scraped off by the cleaning blade 37. As a result, the unnecessary remains of the toner may be removed from the surface of the photosensitive drum 32.

Further, in the transfer unit 40, part of the toner that has been moved onto the surface of the intermediate transfer belt 41 in the primary transfer process may sometimes not be moved onto the surface of the print medium M in the secondary transfer process and may remain on the surface of the intermediate transfer belt 41.

To address this, the cleaning blade 47 may scrape off the remains of the toner present on the surface of the intermediate transfer belt 41 in the transfer unit 40 upon traveling of the intermediate transfer belt 41 in the direction indicated by the arrow F5. As a result, unnecessary remains of the toner may be removed from the surface of the intermediate transfer belt 41.

The image forming operation may be thus completed.

[Fixing Temperature Switching Operation]

Upon performing the fixing operation described above, the image forming apparatus may perform an operation of switching the fixing temperature on the basis of the type of the toner as described below, for example.

Figure 5:
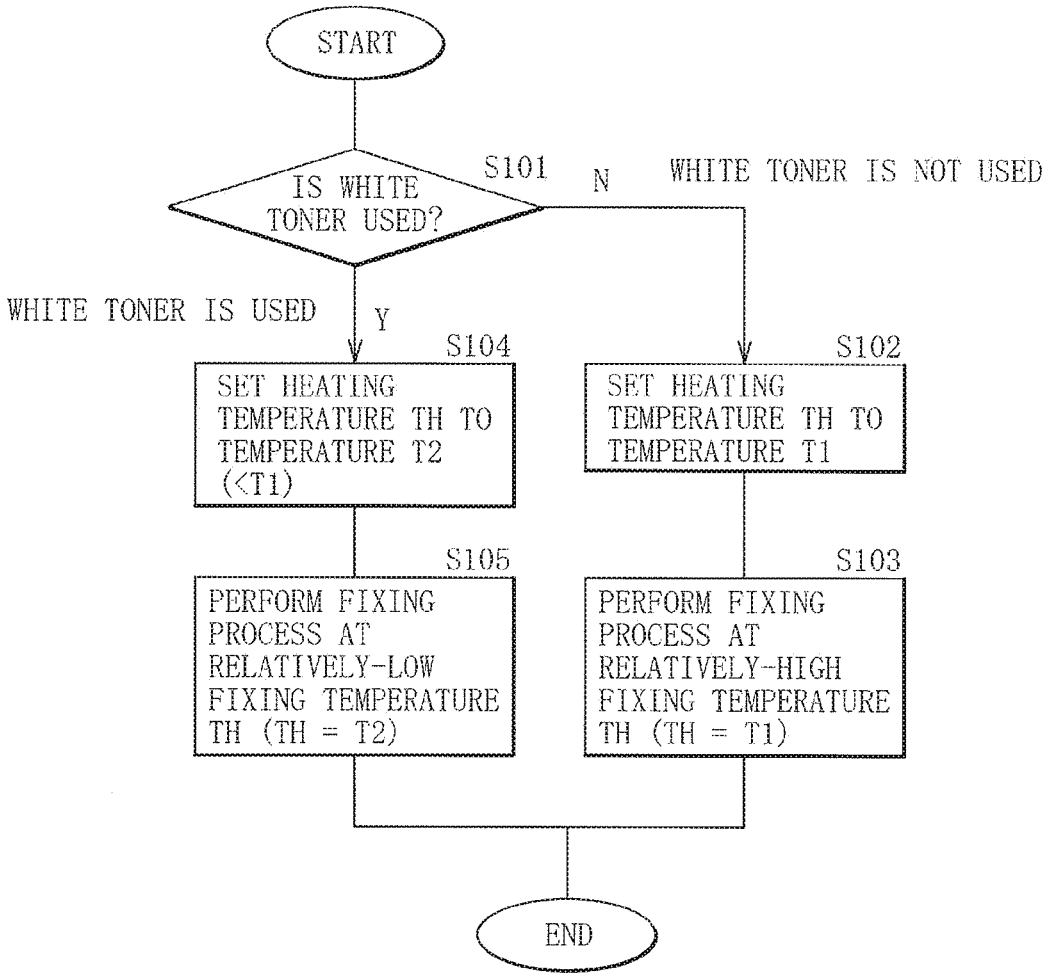
FIG. 5 is a flowchart describing an example of an operation of the image forming apparatus according to the first example embodiment.

FIG. 5 illustrates an example of a flow that describes the operation of switching the fixing temperature on the basis of the type of the toner. As described above, the heating temperature TH referred to in FIG. 5 may be the surface temperature of the fixing belt 55 which is measured by the heating thermistor 58, and the temperature that determines the fixing temperature.

Referring to FIG. 5, upon performing the fixing process, the fixing controller 87 may first determine whether the white toner is used when the developing process and the transfer process are performed on the print medium M fed to the fixing unit 50 (step S101).

A case in which the white toner is used to form the image may include both a case in which only the white toner is used and a case in which one or more of the yellow toner, the magenta toner, the cyan toner, and the black toner are used together with the white toner. In other words, the "case in which the white toner is used" described herein may not include a case where only one or more of the yellow toner, the magenta toner, the cyan toner, and the black toner are used without the use of the white toner.

In this case, the controller 71 may output, to the fixing controller 87, a signal, i.e., information regarding whether the white toner is used, for example. The fixing controller 87 may be thereby able to determine whether the white toner is used.

When the fixing controller 87 determines that the white toner is not used (step S101: N), the fixing controller 87 may set the heating temperature TH to the relatively-high temperature T1 (step S102). The temperature T1 may be a temperature that is typically set for the fixing process, and may be sufficiently high to perform the fixing process. The temperature T1 is not particularly limited in its range. One example of the range of the temperature T1 may be equal to or higher than 165° C. Another example of the range of the temperature T1 may be from 165° C., to 175° C. both inclusive. Thus, the fixing temperature may be set to the relatively-high temperature, in which case the heating temperature TH equals the relatively-high temperature T1, i.e., TH=T1.

When the surface temperature of the fixing belt 55 measured by the eating thermistor 58 is lower than the temperature T1 upon the setting of the heating temperature TH, the fixing controller 87 may increase the heating temperature at which the fixing belt 55 is heated by the heater 56, to thereby cause the surface temperature of the fixing belt 55 to be increased until the surface temperature of the fixing belt 55 reaches the temperature T1, for example. It is to be noted that, in one example case where the heater 56 is not in operation, the fixing controller 87 may cause the heater 56 to be in operation, to thereby start heating of the fixing belt 55 by the heater 56, for example.

When the surface temperature of the fixing belt 55 measured by the heating thermistor 58 is higher than the temperature T1 upon the setting of the heating temperature TH, the fixing controller 87 may decrease the heating temperature at which the fixing belt 55 is heated by the heater 56, to thereby cause the surface temperature of the fixing belt 55 to be decreased until the surface temperature of the fixing belt 55 reaches the temperature T1, for example. In this case, the fixing controller 87 may halt the heating of the fixing belt 55 by the heater 56, by causing the heater 56 to stop operating, for example.

Lastly, the fixing controller 87 may cause the fixing process to be performed at the relatively-high fixing temperature described above (TH=T1) (step S103). As used herein, the wording "the fixing temperature is relatively high" and its variants refer to that the fixing temperature is higher than a temperature, i.e., the later-described temperature T2, that is set when the fixing controller 87 determines that the white toner is used.

In contrast, when the fixing controller 87 determines that the white toner is used (step S101; Y), the fixing controller 87 may set the heating temperature TH to the relatively-low temperature T2 (step S104). In other words, the fixing controller 87 may set the heating temperature TH to be the temperature T2 that is lower than the temperature T1 described above. The temperature T2 may be lower than the temperature that is typically set in the fixing process, i.e., lower than the temperature that is sufficiently high to perform the fixing process. The temperature T2 may be, however, a temperature that allows for substantial completion of the fixing process. The temperature T2 is not particularly limited in its range. One example of the range of the temperature T2 may be equal to or lower than 165° C. Another example of the range of the temperature T2 may be from 155° C. to 165° C. both inclusive. Thus, the fixing temperature may be set to the relatively-low temperature, in which case the heating temperature TH equals the relatively-low temperature T2, i.e., TH=T2.

When the surface temperature of the fixing belt 55 measured by the heating thermistor 58 is lower than the temperature T2 upon the setting of the heating temperature TH, the fixing controller 87 may increase the heating temperature at which the fixing belt 55 is heated by the heater 56, to thereby cause the surface temperature of the fixing belt 55 to be increased until the surface temperature of the fixing belt 55 reaches the temperature T2, for example. It is to be noted that, in one example case where the heater 56 is not in operation, the fixing controller 87 may cause the heater 56 to be in operation, to thereby start the heating of the fixing belt 55 by the heater 56, for example.

When the surface temperature of the fixing belt 55 measured by the heating thermistor 58 is higher than the temperature T2 upon the setting of the heating temperature TH, the fixing controller 87 may decrease the heating temperature at which the fixing belt 55 is heated by the heater 56, to thereby cause the surface temperature of the fixing belt 55 to be decreased until the surface temperature of the fixing belt 55 reaches the temperature T2, for example. In this case, the fixing controller 87 may halt the heating of the fixing belt 55 by the heater 56, by causing the heater 56 to stop operating, for example.

Lastly, the fixing controller 87 may cause the fixing process to be performed at the relatively-low fixing temperature described above (TH=T2) (step S105). As used herein, the wording "the fixing temperature is relatively low" and its variants refer to that the fixing temperature is lower than a temperature, i.e., the temperature T1, that is set when the fixing controller 87 determines that the white toner is not used.

This may complete the operation of switching the fixing temperature on the basis of the type of the toner.

1-7. Workings and Effects

The image forming apparatus may switch the fixing temperature on the basis of the type of the toner when the fixing process is performed by the use of the yellow toner, the magenta toner, the cyan toner, and the black toner, as well as the white toner together. For example, the fixing temperature in the case where the white toner is used may be lower than the fixing temperature in the case where each of the yellow toner, the magenta toner, the cyan toner, and the black toner is used. As a result, it is possible to stably form a high-quality image for the following reasons.

In the following description referring to FIGS. 1 and 3, the yellow toner, the magenta toner, the cyan toner, and the black toner may be collectively referred to as "the yellow toner, etc."

As described above, the yellow toner, etc. that are the non-metal-containing toners have the high electric charge characteristics. Therefore, when an image is formed by the use of the yellow toner, etc., a phenomenon called "overlapping" is less likely to occur. The "overlapping" is a phenomenon in which the toner is unintentionally transferred onto a place onto which the toner should not be transferred, and the place is therefore stained by the toner. The place onto which the toner should not be transferred may be a blank portion of the print medium M, for example.

In this case, when the intermediate transfer belt 41 comes into contact with the secondary transfer roller 46 upon the transfer, onto the print medium M, of the yellow toner, etc, that have been transferred onto the intermediate transfer belt 41, it may be difficult for the yellow toner, etc. to be moved from the intermediate transfer belt 41 onto the secondary transfer roller 46. Hence, it may be difficult for the yellow toner, etc. to be attached to the surface of the secondary transfer roller 46.

It is to be noted that, even when the yellow toner, etc. are attached to the surface of the secondary transfer roller 46, it may be easy to remove the attached yellow toner, etc. from the surface of the secondary transfer roller 46 when an inversely-biased voltage is applied to the secondary transfer roller 46 upon non-formation of the image or at any other timing.

In contrast, the white toner that is the metal-containing toner has the low electric charge characteristics. Therefore, when an image is formed by the use of the white toner, the foregoing phenomenon called "overlapping" is likely to occur.

In this case, when the intermediate transfer belt 41 comes into contact with the secondary transfer roller 46 upon the transfer, onto the print medium M, of the white toner that has been transferred onto the intermediate transfer belt 41, it may be easy for the white toner to be moved from the intermediate transfer belt 41 onto the secondary transfer roller 46. Hence, it may be easy for the white toner to be attached to the surface of the secondary transfer roller 46.

Unlike the foregoing case of the yellow toner, etc., when the white toner is attached to the surface of the secondary transfer roller 46, it may be difficult to remove the attached white toner from the surface of the secondary transfer roller 46, even when the inversely-biased voltage is applied to the secondary transfer roller 46. In this case, it may be easy for the white toner to be accumulated on the surface of the secondary transfer roller 46.

In the case where the white toner that easily results in the "overlapping" is attached to the surface of the secondary transfer roller 46, first, the secondary transfer roller 46 may come into contact with the back surface of the print medium M when the print medium M passes between the backup roller 44 and the secondary transfer roller 46 in the subsequent secondary transfer process. This may cause the white toner attached to the surface of the secondary transfer roller 46 to be moved to the back surface of the print medium M. As a result, the white toner may be attached to the back surface of the print medium M.

Thereafter, when the print medium M having the back surface attached with the white toner is fed to the fixing unit 50, the pressure applying roller 52 may come into contact with the back surface of the print medium M. This may cause the white toner attached to the back surface of the print medium M to be moved onto the surface of the pressure applying roller 52. As a result, the white toner may be attached to the surface of the pressure applying roller 52.

In this case, the surface temperature of the pressure applying roller 52 may be high which is so pressed against the fixing belt 55 as to be in contact with the fixing belt 55. One reason for this is that the fixing belt 55 is heated by the heater 56. This may make it easier for the white toner to be moved from the back surface of the print medium M onto the surface of the pressure applying roller 52. In other words, it is easier for the white toner attached to the back surface of the print medium M to be attached to the surface of the pressure applying roller 52 as the temperature upon the fixing process, i.e., the fixing temperature, is higher.

Lastly, the pressure applying roller 52 may come into contact with the back surface of the print medium M when the print medium M passes between the pressure applying roller 52 and the fixing belt 55 upon the subsequent fixing process. Therefore, when the white toner attached to the surface of the pressure applying roller 52 is accumulated, the white toner attached to the surface of the pressure applying roller 52 may be moved onto the back surface of the print medium M. As a result, the white toner may be attached to the back surface of the print medium M.

In this case, the surface temperature of the pressure applying roller 52 may be high as described above. Therefore, it may be easier for the white toner to be moved from the surface of the pressure applying roller 52 onto the back surface of the print medium M. In other words, it may be easier for the white toner attached to the surface of the pressure applying roller 52 to be attached to the back surface of the print medium M as the fixing temperature is higher.

As described above, in the case where the white toner is used to form the image, the white toner may be attached to the secondary transfer roller 46. This may makes it easier for the white toner to be attached to the back surface of the print medium M on which the image is to be formed thereafter. It is easier for the white toner to be attached to the back surface of the print medium M as the fixing temperature is higher, as described above.

In a case where the fixing temperature is constantly set to the high temperature, i.e., the temperature T1, independently of the type of the toner, the fixing process may be performed favorably; however, a concern may be raised regarding a state of the image.

For example, in the case where an image is formed by the use of the yellow toner, etc., the yellow toner, etc. may be sufficiently fixed to the print medium M. Therefore, the image formed by the use of the yellow toner, etc. may be formed stably. In the case where an image is formed by the use of the white toner, the white toner may be sufficiently fixed to the print medium M. Therefore, the image formed by the use of the white toner may be formed stably; however, it is easier for the white toner to be attached to the back surface of the print medium M upon the image formation, i.e., the fixing process, to be performed thereafter, as described above.

When the white toner is attached to the back surface of the print medium M, the print medium M on which the image is formed may be stained. In addition, in the case where the images are formed on the both surfaces of the print medium M, the quality of the image formed on the back sides of the print medium M may be remarkably decreased.

Accordingly, it may be difficult to stably obtain a high-quality image in the case where the image is formed by using the yellow toner, etc. and the white toner together.

In contrast, in the case where the fixing temperature is switched on the basis of the type of the toner, the fixing process may be performed favorably while ensuring the state of the image.

For example, in the case where the image is formed by the use of the yellow toner, etc., the fixing temperature may be set to the sufficiently-high temperature, i.e., the temperature T1. This may allow the yellow toner, etc. to be sufficiently fixed to the print medium M. Hence, the image formed by the use of the yellow toner, etc. may be formed stably. In addition, in the case where the image is formed by the use of the white toner, the fixing temperature may be set to the temperature, i.e., the temperature 12, that is lower than the foregoing temperature, i.e., the temperature T1, that is sufficiently high. This may allow the white toner to be fixed to the print medium M. Hence, the image is formed stably by the use of the white toner. Further, this may make it difficult for the white toner to be attached to the back surface of the print medium M upon the subsequent image formation, i.e., the subsequent fixing process.

Thus, upon forming the image by the use of both the yellow toner, etc. and the white toner together the white toner is fixed to the print medium M together with the yellow toner, etc. while the attachment of the white toner to the back surface of the print medium M is suppressed. Hence, it is possible to stably obtain a high-quality image.

In other words, in the above-described image forming apparatus, it is possible to achieve superior effects, for example, when the yellow toner, etc. having the electric charge amount of the great absolute value and the white toner having the electric charge amount of the small absolute value are together.

When the binder resin included in the white toner includes the crystalline polyester, it is further easier for the white toner to be fixed to the print medium M. Hence, it is possible to achieve further superior effects.

2. Image Forming Apparatus (Second Example Embodiment)

A description is given next of an image forming apparatus according to a second example embodiment of the technology. In the description below, the components of the image forming apparatus according to the first example embodiment may be referred to where appropriate.

The foregoing image forming apparatus according to the first example embodiment may switch the fixing temperature, i.e., the heating temperature TH, on the basis of the type of the toner. Unlike such an image forming apparatus according to the first example embodiment, however, the image forming apparatus according to the second example embodiment may so switch, on the basis of the type of the toner, a pressure applying temperature TP that a temperature difference ΔT at the time of fixing satisfies an appropriate condition. The temperature difference ΔT will be described later in greater detail. The pressure applying temperature TP may be a surface temperature of the pressure applying roller 52.

2-1. Configuration

Figure 6:
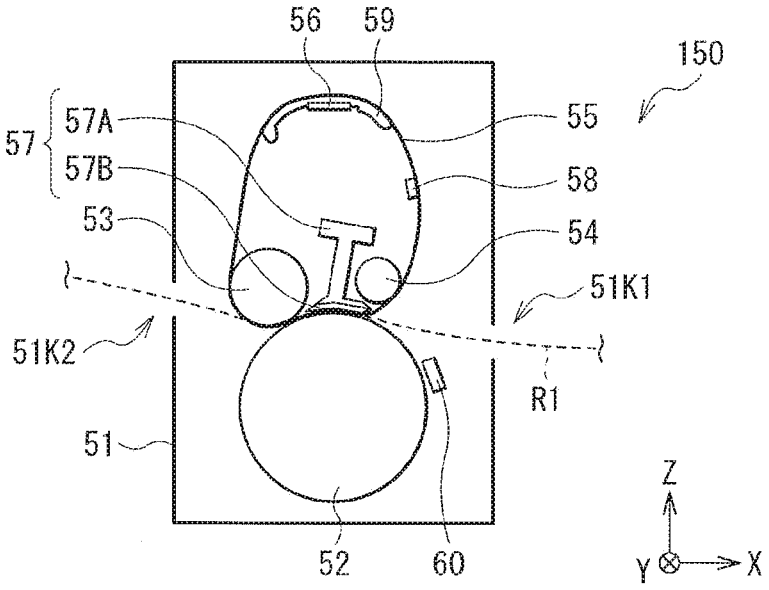
FIG. 6 is a plan view of an example of a configuration of a main part, i.e., a fixing unit, of an image forming apparatus according to a second example embodiment of the technology.
Figure 7:
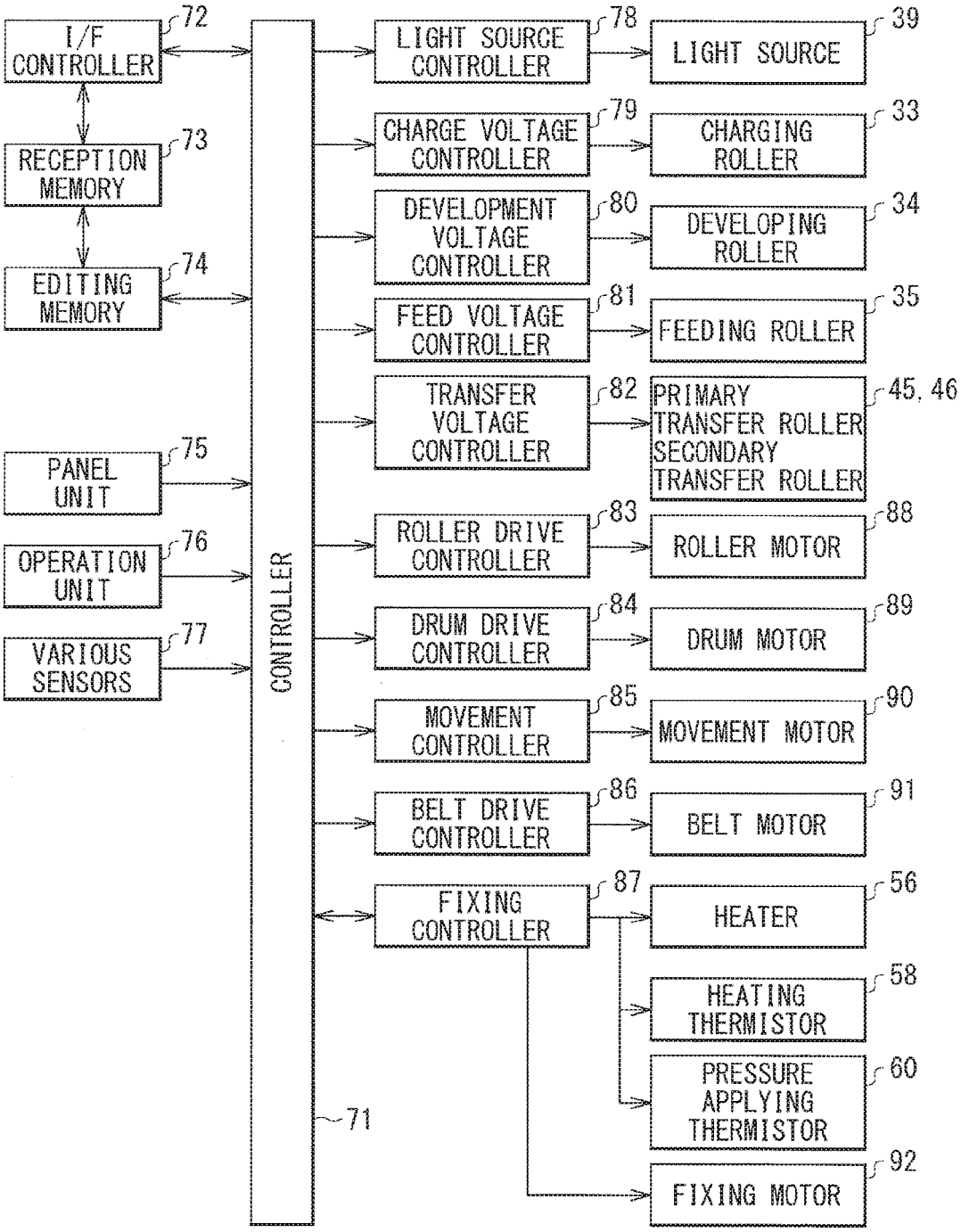
FIG. 7 is a block diagram illustrating an example of a configuration of the image forming apparatus according to the second example embodiment.

FIG. 6 corresponding to FIG. 3 illustrates an example of a planar configuration of a main part, i.e., a fixing unit 150, of the image forming apparatus according to the second example embodiment. FIG. 7 corresponding to FIG. 4 illustrates an example of a block configuration of the image forming apparatus according to the second example embodiment.

The image forming apparatus described below may have a configuration similar to that of the image forming apparatus according to the first example embodiment, except that the fixing unit 150 is provided in place of the fixing unit 50 as illustrated in FIG. 6, for example.

The fixing unit 150 may be able to switch the pressure applying temperature TP on the basis of the type of the toner, as described above. The fixing unit 150 may have a configuration similar to that of the fixing unit 50 except for points described below, for example.

For example, the fixing unit 150 may further include a pressure applying thermistor 60. The pressure applying thermistor 60 may mainly measure the surface temperature of the pressure applying roller 52, i.e., the pressure applying temperature TP. The pressure applying temperature TP may not be the surface temperature of the fixing belt 55 heated by the heater 56, i.e., the heating temperature TH. Therefore, the pressure applying temperature TP may be different from the fixing temperature.

The pressure applying roller 52 may be so pressed against the fixing belt 55 as to be in contact with the fixing belt 55 as described above. Therefore, the pressure applying roller 52 may not be directly heated by the heater 56, and may be indirectly heated by the heater 56 with the fixing belt 55 in between. Accordingly, there may be a tendency that the pressure applying temperature TP is lower than the heating temperature TH.

The pressure applying temperature TP may be controlled in accordance with the heating temperature TH, for example. Therefore, the pressure applying temperature TP may be controlled indirectly by the heater 56. In other words, the pressure applying temperature TP may be increased when the heating temperature TH is increased, and the pressure applying temperature TP may be decreased when the heating temperature TH is decreased.

The pressure applying thermistor 60 is not particularly limited in its position, as long as the pressure applying thermistor 60 is located at a position that allows for the measurement of the surface temperature of the pressure applying roller 52. For example, the pressure applying thermistor 60 may be located in the vicinity of the surface of the pressure applying roller 52. In one example, the pressure applying thermistor 60 may be located at a location that is sufficiently away from the fixing belt 55, in order to make it difficult for the pressure applying thermistor 60 to be influenced by the fixing belt 55 directly heated by the heater 56.

The pressure applying roller 52 may be disposed on the opposite side, of the intermediate transfer belt 41, to the side on which the print medium M comes into contact with the intermediate transfer belt 41, as described above. In other words, the pressure applying roller 52 may be disposed on the lower side of the conveyance route R1. Therefore, the pressure applying roller 52 may correspond to a "pressure applying member" in one specific but non-limiting embodiment of the technology.

The fixing belt 55 may be disposed on the side, of the intermediate transfer belt 41, on which the print medium M comes into contact with the intermediate transfer belt 41, as described above. In other words, the fixing belt 55 may be disposed on the upper side of the conveyance route R1. Therefore, the fixing belt 55 may correspond to a "heating member" in one specific but non-limiting embodiment of the technology.

The image forming apparatus according to the second example embodiment may have a block configuration similar to that of the image forming apparatus according to the first example embodiment except for the following points as illustrated in FIG. 7, for example.

The fixing controller 87 may mainly control an operation of the heater 56 on the basis of the pressure applying temperature TP measured by the pressure applying thermistor 60.

As described above, the fixing controller 87 may so switch, on the basis of the type of the toner used to form an image, the pressure applying temperature TP that the temperature difference ΔT at the time of the fixing satisfies the appropriate condition. The fixing controller 87 may perform the foregoing switching of the pressure applying temperature TP, when the fixing unit 50 fixes the toner to the print medium M. A glass-transition temperature TG of the white toner may be registered in the fixing controller 87, for example. The information such as the glass-transition temperature TG may be stored in a memory, for example. Non-limiting examples of the memory may include a random access memory (RAM).

For example, when the white toner is not transferred onto the print medium M, and one or more of the yellow toner, the magenta toner, the cyan toner, and the black toner are transferred onto the print medium M, the fixing controller 87 may set the pressure applying temperature TP to a relatively-high temperature T3. The fixing controller 87 may thereby cause the fixing process to be performed at the relatively-high pressure applying temperature (TP=T3).

In contrast, when the white toner is transferred onto the print medium M, the fixing controller 87 may so set the pressure applying temperature TP that the temperature difference ΔT at the time of the fixing satisfies the appropriate condition. For example, the fixing controller 87 may control the pressure applying temperature TP to be a temperature T4 on the basis of the pressure applying temperature TP measured by the pressure applying thermistor 60. The temperature T4 may be lower than the foregoing temperature T3. The fixing controller 87 may thereby cause the temperature difference ΔT at the time of the fixing to satisfy the appropriate condition. In such a manner, the fixing controller 87 may cause the pressure applying temperature TP in the case where the white toner is used to be lower than the pressure applying temperature TP in the case where the white toner is not used.

A detailed description of the operation of switching the pressure applying temperature TP on the basis of the type of the toner will be given later with reference to FIG. 8. The description will include the details of the appropriate condition of the temperature difference ΔT at the time of the fixing.

One reason is as follows why attention is focused not on the fixing temperature, i.e., the heating temperature TH, but on the pressure applying temperature TP as the temperature to be switched on the basis of the type of the toner. That is, the white toner moved from the surface of the intermediate transfer belt 41 to the surface of the secondary transfer roller 46 may eventually moved from the surface of the pressure applying roller 52 to the back surface of the print medium M, as described above. In other words, whether the white toner is eventually attached to the back surface of the print medium M may be influenced more easily by the surface temperature of the pressure applying roller 52 that comes into contact with the back surface of the print medium M than by the surface temperature of the fixing belt 55 that does not come into contact with the back surface of the print medium M. In other words, whether the white toner is eventually attached to the back surface of the print medium M may be influenced more easily by the pressure applying temperature TP than by the heating temperature TH. An attachment situation of the white toner may be varied easily in accordance with the temperature of the vicinity of the back surface of the print medium M. The attachment situation of the white toner may include how easily the white toner is attached, the amount of the attached white toner, or any other factor, for example. Therefore, it is effective to control the pressure applying temperature TP than to control the heating temperature TH, in order to suppress the eventual attachment of the white toner to the back surface of the print medium M.

The glass-transition temperature TG of the white toner is not particularly limited. In one example, however, the glass-transition temperature TG of the white toner may be equal to or lower than 60° C. In another example, the glass-transition temperature TG of the white toner may be equal to or lower than 52° C. There is a tendency that it is easier for the white toner attached to the surface of the pressure applying roller 52 to be attached to the back surface of the print medium M as the glass-transition temperature TG is lower. Therefore, when the glass-transition temperature TG falls within the foregoing range, it is possible to effectively suppress the attachment of the white toner to the back surface of the print medium M.

2-2. Operation

The image forming apparatus according to the second example embodiment may perform an operation similar to that of the image forming apparatus according to the first example embodiment, except that the operation of switching the pressure applying temperature TP is performed in place of the operation of switching the fixing temperature, as described below, for example.

Figure 8:
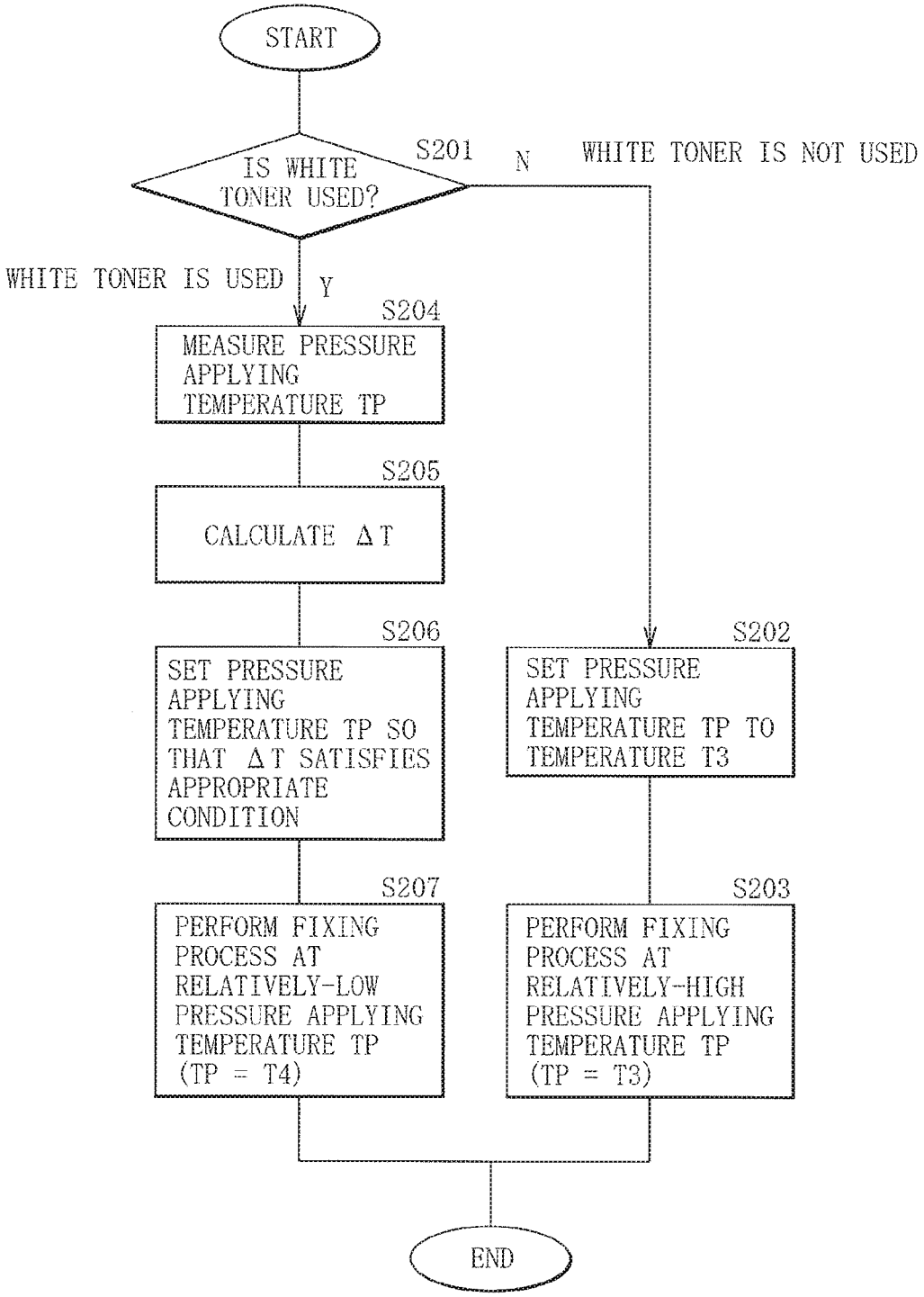
FIG. 8 is a flowchart describing an example of an operation of the image forming apparatus according to the second example embodiment.

FIG. 8 corresponding to FIG. 5 illustrates an example of a flow that describes the operation of switching the pressure applying temperature TP on the basis of the type of the toner.

Referring to FIG. 8, upon performing the fixing process, the fixing controller 87 may first determine whether the white toner is used when the developing process and the transfer process are performed on the print medium M fed to the fixing unit 150 (step S201).

When the fixing controller 87 determines that the white toner is not used (step S201: N), the fixing controller 87 may set the pressure applying temperature TP to the relatively-high temperature T3 (step S202). The temperature T3 may be a temperature corresponding to the heating temperature TH that is typically set for the fixing process (TH=T1), and may be sufficiently high to perform the fixing process. There is, however, a tendency that the temperature T3 is lower than the temperature T1, as described above. The temperature T3 is not particularly limited in its range. One example of the range of the temperature T3 may be equal to or higher than 165° C. Another example of the range of the temperature T3 may be from 165° C. to 175° C. both inclusive.

When the surface temperature of the pressure applying roller 52 measured by the pressure applying thermistor 60 is lower than the temperature T3 upon the setting of the pressure applying temperature TP, the fixing controller 87 may increase the heating temperature at which the fixing belt 55 is heated by the heater 56, to thereby cause the surface temperature of the pressure applying roller 52 to be increased until the surface temperature of the pressure applying roller 52 reaches the temperature T3, for example. It is to be noted that, in one example case where the heater 56 is not in operation, the fixing controller 87 may cause the heater 56 to be in operation, to thereby start heating of the fixing belt 55 by the heater 56, for example.

When the surface temperature of the pressure applying roller 52 measured by the pressure applying thermistor 60 is higher than the temperature T3 upon the setting of the pressure applying temperature TP, the fixing controller 87 may decrease the heating temperature at which the fixing belt 55 is heated by the heater 56, to thereby cause the surface temperature of the pressure applying roller 52 to be decreased until the surface temperature of the pressure applying roller 52 reaches the temperature T3, for example. In this case, the fixing controller 87 may halt the heating of the fixing belt 55 by the heater 56, by causing the heater 56 to stop operating, for example.

The pressure applying temperature TP may be controllable by varying a conveyance speed at which the print medium M is conveyed, i.e., a medium passing speed, for example. For example, the pressure applying temperature TP may be decreased when the conveyance speed of the print medium M is decreased, and the pressure applying temperature TP may be increased when the conveyance speed of the print medium M is increased.

Lastly, the fixing controller 87 may cause the fixing process to be performed at the relatively-high pressure applying temperature TP described above (TP=T3) (step S203). As used herein, the wording "the pressure applying temperature TP is relatively high" and its variants refer to that the pressure applying temperature TP is higher than a temperature, i.e., the later-described temperature T4, that is set when the fixing controller 87 determines that the white toner is used.

In contrast, when the fixing controller 87 determines that the white toner is used (step S201: Y), the fixing controller 87 may measure the pressure applying temperature TP by means of the pressure applying thermistor 60 (step S204).

Thereafter, the fixing controller 87 may calculate a difference, at the time of the fixing, between the pressure applying temperature TP and the glass-transition temperature TG (the temperature difference ΔT at the time of the fixing=TP−TG), on the basis of the pressure applying temperature TP and the glass-transition temperature TG of the white toner (step S205).

Thereafter, the fixing controller 87 may so set the pressure applying temperature TP that the temperature difference ΔT at the time of the fixing satisfies the appropriate condition (step S206). For example, the fixing controller 87 may control the pressure applying temperature TP to be the relatively-low temperature T4, to thereby cause the temperature difference ΔT at the time of the fixing to satisfy a condition represented by the following expression (1), $$68^\circ\ \text{C.} \leq \Delta T \leq 101^\circ\ \text{C.} \quad (1)$$

where ΔT denotes the difference between the pressure applying temperature TP and the glass-transition temperature TG.

The appropriate condition regarding the temperature difference ΔT at the time of the fixing represented by the expression (1) may make it possible to fix the white toner to the print medium M while suppressing the movement, of the white toner attached to the surface of the pressure applying roller 52, to the back surface of the print medium M. The foregoing appropriate condition may be derived from taking into consideration the temperature difference ΔT at the time of the fixing, the attachment situation of the white toner, i.e., the situation of the attachment of the white toner to the print medium M, and the fixing situation of the white toner, i.e., a situation of fixing of the white toner to the print medium M.

When the temperature difference ΔT at the time of the fixing is lower than a lower limit value of the foregoing appropriate condition, i.e., 68° C., upon the setting of the pressure applying temperature TP, the fixing controller 87 may cause the surface temperature of the pressure applying roller 52 to be increased until the surface temperature of the pressure applying roller 52 reaches the temperature T3, in accordance with the increasing of the heating temperature at which the fixing belt 55 is heated by the heater 56, for example. The fixing controller 87 may thereby cause the temperature difference ΔT to be increased until the temperature difference ΔT to be higher than the lower limit value. It is to be noted that, in one example case where the heater 56 is not in operation, the fixing controller 87 may cause the heater 56 to be in operation, to thereby start heating of the fixing belt 55 by the heater 56, for example.

When the temperature difference ΔT at the time of the fixing is higher than an upper limit value of the foregoing appropriate condition, i.e., 101° C., upon the setting of the pressure applying temperature TP, the fixing controller 87 may cause the surface temperature of the pressure applying roller 52 to be decreased until the surface temperature of the pressure applying roller 52 reaches the temperature T4, in accordance with the decreasing of the heating temperature at which the fixing belt 55 is heated by the heater 56, for example. The fixing controller 87 may thereby cause the temperature difference ΔT to be decreased until the temperature difference ΔT to be lower than the upper limit value. In this case, the fixing controller 87 may halt the heating of the fixing belt 55 by the heater 56, by causing the heater 56 to stop operating, for example.

In one example, the fixing controller 87 may cause the temperature difference ΔT at the time of the fixing to satisfy a condition represented by the following expression (2). One reason for this is that it is difficult for the white toner to be attached not only to the back surface of the print medium M but to the surface of the pressure applying roller 52.

$$68° C. \leq \Delta T \leq 94° C. \quad (2)$$

Lastly, the fixing controller 87 may cause the fixing process to be performed at the relatively-low pressure applying temperature TP described above (TP=T4) (step S207). As used herein, the wording "the pressure applying temperature TP is relatively low" and its variants refer to that the pressure applying temperature TP is lower than a temperature, i.e., the temperature T3, that is set when the fixing controller 87 determines that the white toner is not used.

The operation of switching the pressure applying temperature TP on the basis of the type of the toner may be thus ended.

2-3. Workings and Effects

The image forming apparatus according to the second example embodiment may switch the pressure applying temperature TP on the basis of the type of the toner when the fixing process is performed by the use of the yellow toner, the magenta toner, the cyan toner, and the black toner, as well as the white toner together. For example, in the case where the white toner is used, the pressure applying temperature TP may be so set that the temperature difference ΔT at the time of the fixing satisfies the appropriate condition.

In this case, the pressure applying temperature TP may be so made appropriate as to allow the white toner to be fixed to the print medium M, while suppressing the attachment of the white toner to the back surface of the print medium M, as described above. Accordingly, in the case where the image is formed by the use of the yellow toner, etc., the yellow toner, etc. may be sufficiently fixed to the print medium M. Therefore, the image formed by the use of the yellow toner, etc. may be formed stably. In addition, in the case where the image is formed with the use of the white toner, the white toner may be fixed to the print medium M. Therefore, the image may be formed stably by the use of the white toner, and it may be difficult for the white toner to be attached to the back surface of the print medium M at the time of the subsequent image formation, i.e., the subsequent fixing process.

Accordingly, upon forming the image by the use of the yellow toner, the magenta toner, the cyan toner, and the black toner, as well as the white toner together, the white toner is fixed to the print medium M together with the yellow toner, etc., while the attachment of the white toner to the back surface of the print medium M is suppressed. Hence, it is possible to stably obtain a high-quality image.

Other workings and effects regarding the image forming apparatus according to the second example embodiment are similar those of the image forming apparatus according to the first example embodiment.

3. Image Forming Apparatus (Third Example Embodiment)

A description is given next of an image forming apparatus according to a third example embodiment of the technology. In the description below, the components of the image forming apparatus according to the second example embodiment may be referred to where appropriate.

The foregoing image forming apparatus according to the second example embodiment may so switch, on the basis of the type of the toner, the pressure applying temperature TP that the temperature difference ΔT at the time of the fixing satisfies the appropriate condition. Unlike such an image forming apparatus according to the second example embodiment, however, the image forming apparatus according to the third example embodiment may switch the pressure applying temperature TP on the basis of the type of an image forming mode.

3-1. Configuration

The image forming apparatus described below may have a configuration similar to that of the image forming apparatus according to the second example embodiment, except that the controller 71 and the fixing controller 87 may have respective functions different from those in the second example embodiment, as described below referring to FIGS. 1, 2, 6, and 7, for example.

The controller 71 may perform switching between two types of image forming modes in accordance with an instruction inputted by a user of the image forming apparatus by means of the operation unit 76, for example. The two types of image forming modes may include a one-side image forming mode and a both-side image forming mode. The one-side image forming mode may form an image only on one side of the print medium M, i.e., the front surface of the print medium M, by the use of the toner. The both-side image forming mode may form images on both sides of the print medium M, i.e., the front surface and the back surface of the print medium M, by the use of the toner. The one-side image forming mode may correspond to a "first mode" in one specific but non-limiting embodiment of the technology. The both-side image forming mode may correspond to a "second mode" in one specific but non-limiting embodiment of the technology.

The "instruction" inputted by the user by means of the operation unit 76 may be an operation corresponding to one of the image forming modes which the user wants to select. In a case where the operation unit 76 includes buttons directed to the operation by the user, for example, when the button directed to selection of the one-side image forming mode is operated by the user, the controller 71 may select the one-side image forming mode as the image forming mode. In contrast, for example, when the button directed to selection of the both-side image forming mode is operated by the user, the controller 71 may select the both-side image forming mode as the image forming mode.

The fixing controller 87 may switch the pressure applying temperature TP on the basis of the type of the image forming mode selected by the controller 71 as described above.

For example, when the one-side image forming mode is selected by the controller 71, the fixing controller 87 may set the pressure applying temperature TP to the relatively-high temperature T3. The fixing controller 87 may thereby cause the fixing process to be performed at the relatively-high pressure applying temperature TP (TP=T3).

In contrast, when the both-side image forming mode is selected by the controller 71, the fixing controller 87 may so control the pressure applying temperature TP that the pressure applying temperature TP becomes a temperature T5. The temperature T5 may be lower than the foregoing temperature T3 (T5<T3), for example. The fixing controller 87 may thereby cause the fixing process to be performed at the relatively-low pressure applying temperature TP (TP=T5).

One reason is as follows why attention is focused on the image forming mode as a reference on the basis of which the pressure applying temperature TP is switched. That is, in the both-side image forming mode, the image may be formed on the back surface of the print medium M. Therefore, there is a possibility that the white toner is attached to the image formed on the back surface of the print medium M.

For example, in the one-side image forming mode, no image may be formed on the back surface of the print medium M. In this case, the attachment of the white toner to the back surface of the print medium M may only result in a stain on the print medium M, which may not matter much. One reason for this is that the white toner is not attached to the front surface of the print medium M, and the quality of the image formed on the front surface of the print medium M is therefore not decreased due to the attachment of the white toner. Further, even when the white toner is attached to the back surface of the print medium M, the user may possibly not realize the attachment of the white toner on the back surface of the print medium M owing to non-formation of the image on the back surface of the print medium M.

In contrast, in the both-side image forming mode, the image may be formed on the back surface of the print medium M. In this case, when the white toner is attached to the back surface of the print medium M, the quality of the image formed on the back surface of the print medium M may be decreased due to the attachment of the white toner. Further, due to the formation of the image on the back surface of the print medium M it is easy for the user to realize the attachment of the white toner to the back surface of the print medium M when the white toner is attached to the back surface of the print medium M.

Accordingly, it is effective to suppress the attachment of the white toner in the both-side image forming mode in which the image is formed on the back surface of the print medium M, in order to suppress a decrease in quality of the image due to the attachment of the white toner.

3-2. Operation

The image forming apparatus according to the third example embodiment may perform an operation similar to that of the a e forming apparatus according to the second example embodiment, except that the operation of switching the pressure applying temperature TP on the basis of the type of the image forming mode is performed in place of the operation of switching the pressure applying temperature TP on the basis of the type of the toner, as described below, for example.

A procedure of conveying the print medium M in the one-side image forming mode and a procedure of conveying the print medium M in the both-side image forming mode may be as described above, for example.

Figure 9:
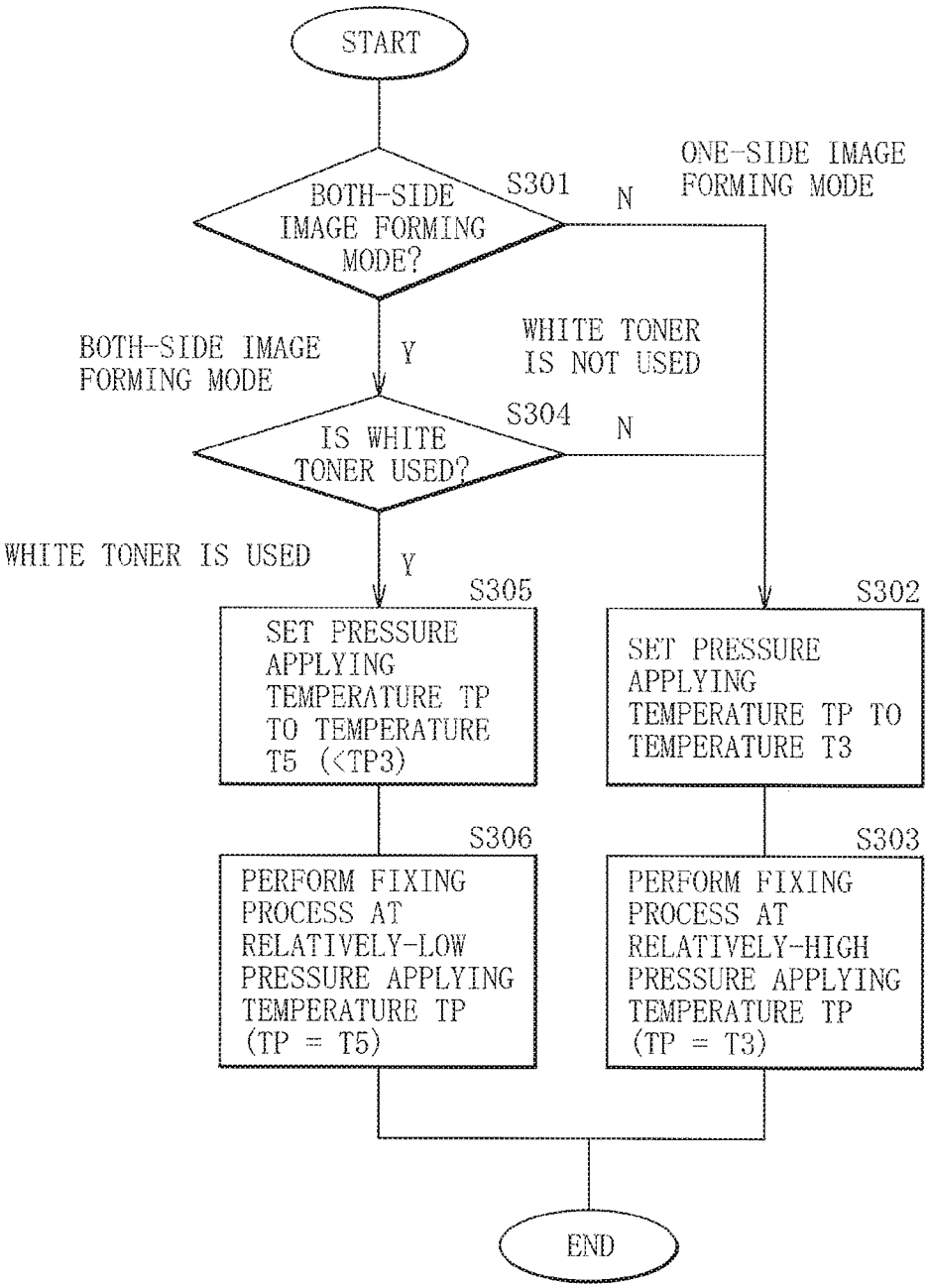
FIG. 9 is a flowchart describing an example of an operation of an image forming apparatus according to a third example embodiment of the technology.

FIG. 9 corresponding to FIG. 8 illustrates an example of a flow that describes the operation of switching the pressure applying temperature TP on the basis of the type of the image forming mode.

Referring to FIG. 9, upon performing the fixing process, the controller 71 may first determine whether the both-side image forming mode is selected by the user of the image forming apparatus by means of the operation unit 76 (step S301).

When the controller 71 determines that the both-side image forming mode is not selected (step S301: N), the controller 71 may determine that the one-side image forming mode is selected by the user, and thereby cause the fixing controller 87 to cause the regular fixing process to be performed.

For example, the fixing controller 87 may set the pressure applying temperature TP to the relatively-high temperature T3 (step S302). Thereafter, the fixing controller 87 may cause the fixing process to be performed at the relatively-high pressure applying temperature TP (TP=T3) (step S303).

When the controller 71 determines that the both-side image forming mode is selected (step S301: Y), the controller 71 may determine that the both-side image forming mode is selected by the user, and thereby cause the fixing controller 87 to cause a fixing process different from the regular fixing process to be performed.

For example, the fixing controller 87 may determine whether the white toner is used when the developing process and the transfer process are performed on the print medium M fed to the fixing unit 150 (step S304).

When the fixing controller 87 determines that the white toner is not used (step S304: N), the fixing controller 87 may cause the foregoing regular fixing process to be performed (steps S302 and S303).

In contrast, when the fixing controller 87 determines that the white toner is used (step S304: Y), the fixing controller 87 may set the pressure applying temperature TP to the temperature T5 that is lower than the foregoing temperature T3 (step S305).

When the surface temperature of the pressure applying roller 52 measured by the pressure applying thermistor 60 is lower than the temperature T3 upon the setting of the pressure applying temperature TP, the fixing controller 87 may cause the heating of the fixing belt 55 by the heater 56 to be maintained, for example. The fixing controller 87 may thereby cause the surface temperature of the pressure applying roller 52 to be maintained.

When the surface temperature of the pressure applying roller 52 measured by the pressure applying thermistor 60 is higher than the temperature T3 upon the setting of the pressure applying temperature TP, the fixing controller 87 may decrease the heating temperature at which the fixing belt 55 is heated by the heater 56, for example. The fixing controller 87 may thereby cause the surface temperature of the pressure applying roller 52 to be decreased until the surface temperature of the pressure applying roller 52 reaches the temperature T5, for example. In this case, the fixing controller 87 may halt the heating of the fixing belt 55 by the heater 56, by causing the heater 56 to stop operating, for example.

Lastly, the fixing controller 87 may cause the fixing process to be performed at the relatively-low pressure applying temperature TP described above (TP=T5) (step S306).

The operation of switching the pressure applying temperature TP on the basis of the type of the image forming mode may be thus ended.

3-3. Workings and Effects

The image forming apparatus according to the third example embodiment may switch the pressure applying temperature TP on the basis of the type of the image forming mode when the fixing process is performed by the use of the yellow toner, the magenta toner, the cyan toner, and the black toner, as well as the white toner together. For example, in the both-side image forming mode, the pressure applying temperature TP may be set to the temperature T5 that is lower than the temperature T3 set in the one-side image forming mode.

In this case, the pressure applying temperature TP may be so made appropriate as to allow the white toner to be fixed to the print medium M, while suppressing the attachment of the white toner to the back surface of the print medium M, as described above. Accordingly, in the case where the image is formed by the use of the yellow toner, etc., the yellow toner, etc. may be sufficiently fixed to the print medium M. Therefore, the image formed by the use of the yellow toner, etc. may be formed stably. In addition, in the case where the image is formed with the use of the white toner, the white toner may be fixed to the print medium M. Therefore, the image may be formed stably by the use of the white toner, and it may be difficult for the white toner to be attached to the back surface of the print medium M at the time of the subsequent image formation, i.e., the subsequent fixing process.

Accordingly, upon forming the image by the use of the yellow toner, the magenta toner, the cyan toner, and the black toner, as well as the white toner together, the white toner is fixed to the print medium M together with the yellow toner, etc., while the attachment of the white toner to the back surface of the print medium M is suppressed. Hence, it is possible to stably obtain a high-quality image.

Other workings and effects regarding the image forming apparatus according to the third example embodiment are similar to those of the image forming apparatus according to the second example embodiment.

4. Modification Examples

The configurations of the respective image forming apparatuses described above may be modified where appropriate.

Modification Example 1

For example, the white toner may be used as the metal-containing toner in each of the first example embodiment, the second example embodiment, and the third example embodiment. The type of the metal-containing toner is, however, not particularly limited. Therefore, the metal-containing toner may be any toner other than the white toner. Non-limiting example of the toner other than the white toner may include a brilliant toner that has metallic brilliance.

The brilliant toner may have a configuration similar to that of the white toner except that a brilliant colorant is included in place of the white colorant, for example. Non-limiting examples of the brilliant colorant may include aluminum and a pearl pigment. Non-limiting examples of the pearl pigment may include a pigment in which a thin-flake-like inorganic crystalline substrate is covered with a titanium oxide. It is to be noted that the brilliant toner may include one or more of other colorants such as a pigment of any color and a dye of any color, together with the foregoing brilliant colorant. The brilliant toner is not particularly limited in its color. Non-limiting examples of the color of the brilliant toner may include colors of gold, silver, and copper.

The brilliant toner may have electric charge characteristics similar to those of the white toner. Accordingly, an absolute value of the electric charge amount (μC/g) of the brilliant toner may be sufficiently smaller than an absolute value of the electric charge amount (μC/g) of each of the yellow toner, the magenta toner, the cyan toner, and the black toner. In other words, the brilliant toner may be a low electric charge toner as with the white toner.

Also in a case where the brilliant toner is used as the metal-containing toner, the brilliant toner may be fixed to the print medium M while the attachment of the brilliant toner to the back surface of the print medium M is suppressed. Therefore, effects similar to those described above are achieved.

The metal-containing toner is not particularly limited in its electric charge amount. In one example, the electric charge amount of the metal-containing toner may be equal to or smaller than −4.5 μC/g. In another example, the electric charge amount of the metal-containing toner may be from −8.6 μC/g to −4.5 μC/g. It may be easier for the metal-containing toner to be moved from the intermediate transfer belt 41 to the secondary transfer roller 46 as the electric charge amount of the metal-containing toner is smaller. Therefore, there may be a tendency that it is easier for the metal-containing toner to be attached to the back surface of the print medium M as the electric charge amount of the metal-containing toner is smaller. Accordingly, it is possible to effectively suppress the attachment of the metal-containing toner to the back surface of the print medium M, when the electric charge amount of the metal-containing toner falls within any of the foregoing ranges.

Modification Example 2

For example, four types of non-metal-containing toners, i.e., the yellow toner, the magenta toner, the cyan toner, and the black toner, may be used in each of the first example embodiment, the second example embodiment, and the third example embodiment. The non-metal-containing toner is, however, not particularly limited in its type. Therefore, only one type of non-meal-based toner may be used. Alternatively, two types, three types, or five or more types of non-meal-based toners may be used. In a case where the two types, three types, or five or more types of non-meal-based toners are used, any combination may be set for the colors of the toners. For example, three types of non-metal-containing toners, e.g., the yellow toner, the magenta toner, and the cyan toner, may be used.

Similarly, for example, one type of metal-containing toner, i.e., the white toner, may be used in each of the first example embodiment, the second example embodiment, and the third example embodiment. The metal-containing toner is, however, not particularly limited in its type. Therefore, alternatively, two more types of meal-based toners may be used. For example, two types of metal-containing toners, e.g., the white toner and the brilliant toner, may be used.

Also in the foregoing cases, the metal-containing toner may be fixed to the print medium M, while the attachment of the metal-containing toner to the back surface of the print medium M is suppressed. Therefore, effects similar to those described above are achieved.

Modification Example 3

Moreover, for example, the heater 56 directed to the control of the heating temperature TH, i.e., the heater 56 that heats the fixing belt 55, may be used in order to control the pressure applying temperature TP as illustrated in FIG. 6, in each of the second example embodiment and the third example embodiment. However, alternatively, any other heater directed to heating of the pressure applying roller 52 may be provided inside the pressure applying roller 52 or in the vicinity of the pressure applying roller 52. The pressure applying temperature TP may be controlled by the alternatively-provided heater.

Also in this case, effects similar to those described above are also achieved by controlling the pressure applying temperature TP as described above according to each of the second example embodiment and the third example embodiment. For example, in place of the heater 56 that indirectly heats the pressure applying roller 52, any other heater that directly heats the pressure applying roller 52 may be used. This makes it easier to control the pressure applying temperature TP, leading to further higher effects.

Modification Example 4

Moreover, for example, the fixing controller 87 may control the series of operations regarding the fixing process in each of the first example embodiment, the second example embodiment, and the third example embodiment. However, for example, the controller 71 may also serve as the fixing controller 87, and thereby control the series of operations regarding the fixing process. Also in this case, it is also possible to achieve effects similar to those described above. In the case where the controller 71 also serves as the fixing controller 87, for example, the fixing controller 87 may not be necessarily provided.

Working Examples

A detailed description is provided below of Examples of one example embodiment of the technology.

Examples 1-1 to 1-8

An image was formed by the image forming apparatus according to the first example embodiment illustrated in FIGS. 1 to 4 and a state of the formed image was examined, by the following procedures.

First, the image forming apparatus, the toner, and the print medium M were prepared.

A color printer C942 available from Oki Data Corporation, Tokyo, Japan was used as the image forming apparatus. A printer paper of A4 size ("P" paper, size: 297 mm×210 mm, grammage: 64 g/m$^2$) available from Fuji Xerox Co., Ltd., Tokyo, Japan was used as the print medium M.

Five types of toners were used as the toner. Specifically, four types of non-metal-containing toners, i.e., the yellow toner, the magenta toner, the cyan toner, and the black toner, and one type of metal-containing toner, i.e., the white toner, were used.

The yellow toner had the following composition.

Yellow colorant: 5 parts by mass of Pigment Yellow 74

Binder resin: 100 parts by mass of styrene-acrylic resin (a copolymer of styrene, acrylic acid, and methylmethacrylic acid)

Release agent: 4 parts by mass of paraffin wax

External additive: 3 parts by mass of hydrophobic silica fine powder (R972 available from Nippon Aerosil Co., Ltd., Tokyo, Japan, average particle size: 16 nm) with respect to 100 parts by mass of toner base particles

- 1.6 parts by mass of colloidal silica (sol-gel silica X-24-9163A available from Shin-Etsu Chemical Co., Ltd., Tokyo, Japan, average particle size: 100 nm) with respect to 100 parts by mass of the toner base particles
- 0.2 parts by mass of spherical particles of melamine resin fine powder (EPOSTAR S (registered trademark) available from Nippon Shokubai Co., Ltd., Osaka, Japan, average particle size: 200 nm) with respect to 100 parts by mass of the toner base particles The magenta toner had the following composition.

Magenta colorant: 5 parts by mass of Pigment Red 122

Binder resin: 100 parts by mass of styrene-acrylic resin (a copolymer of styrene, acrylic acid, and methylmethacrylic acid)

Release agent: 4 parts by mass of paraffin wax

External additive: 3 parts by mass of hydrophobic silica fine powder (R972 available from Nippon Aerosil Co., Ltd., Tokyo, Japan, average particle size: 16 nm) with respect to 100 parts by mass of toner base particles

- 1.6 parts by mass of colloidal silica (sol-gel silica X-24-9163A available from Shin-Etsu Chemical Co., Ltd., Tokyo, Japan, average particle size: 100 nm) with respect to 100 parts by mass of the toner base particles
- 0.2 parts by mass of spherical particles of melamine resin fine powder (EPOSTAR S (registered trademark) available from Nippon Shokubai Co., Ltd., Osaka, Japan, average particle size: 200 nm) with respect to 100 parts by mass of the toner base particles The cyan toner had the following composition.

Cyan colorant: 5 parts by mass of Pigment Blue 15:3

Binder resin: 100 parts by mass of styrene-acrylic resin (a copolymer of styrene, acrylic acid, and methylmethacrylic acid)

Release agent: 4 parts by mass of paraffin wax

External additive: 3 parts by mass of hydrophobic silica fine powder (R972 available from Nippon Aerosil Co., Ltd., Tokyo, Japan, average particle size: 16 nm) with respect to 100 parts by mass of toner base particles

- 1.6 parts by mass of colloidal silica (sol-gel silica X-24-9163A available from Shin-Etsu Chemical Co., Ltd., Tokyo, Japan, average particle size: 100 nm) with respect to 100 parts by mass of the toner base particles
- 0.2 parts by mass of spherical particles of melamine resin fine powder (EPOSTAR S (registered trademark) available from Nippon Shokubai Co., Ltd., Osaka, Japan, average particle size: 200 nm) with respect to 100 parts by mass of the toner base particles The black toner had the following composition.

Black colorant: 5 parts by mass of carbon black

Binder resin: 100 parts by mass of styrene-acrylic resin (a copolymer of styrene, acrylic acid, and methylmethacrylic acid)

Release agent: 4 parts by mass of paraffin wax

External additive: 3 parts by mass of hydrophobic silica fine powder (R972 available from Nippon Aerosil Co., Ltd., Tokyo, Japan, average particle size: 16 nm) with respect to 100 parts by mass of toner base particles

- 1.6 parts by mass of colloidal silica (sol-gel silica X-24-9163A available from Shin-Etsu Chemical Co., Ltd., Tokyo, Japan, average particle size: 100 nm) respect to 100 parts by mass of the toner base particles
- 0.2 parts by mass of spherical particles of melamine resin fine powder (EPOSTAR S (registered trademark) available from Nippon Shokubai Co., Ltd., Osaka, Japan, average particle size: 200 nm) with respect to 100 parts by mass of the toner base particles The white toner had the following composition.

White colorant: 100 parts by mass of a titanium oxide

First binder resin: 100 parts by mass of amorphous polyester

Second binder resin: 5 parts by mass of crystalline polyester

Release agent: 4 parts by mass of carnauba wax (powder No. 1 available from S. Kato & Co., Osaka, Japan)

Electric charge control agent: 1 part by mass of BONTRON (registered trademark) E-84 available from Orient Chemical Industries Co., Ltd., Osaka, Japan External additive: 3 parts by mass of hydrophobic silica fine powder (R972 available from Nippon Aerosil Co., Ltd., Tokyo, Japan, average particle size: 15 nm) with respect to 100 parts by mass of toner base particles As a method of manufacturing the yellow toner, the emulsion polymerization aggregation method was used. Specifically, first, primary particles of the polymer material, i.e., the binder resin, were formed in pure water by the emulsion polymerization method. Thereafter, the yellow colorant and the release agent were added to the pure water including the primary particles of the binder resin. Thereafter, the yellow colorant and the release agent were aggregated together with the primary particles of the binder resin in the pure water described above. Secondary particles that were the aggregation bodies of the yellow colorant, the release agent, and the primary particles of the hinder resin were thereby formed. Thereafter, the secondary particles were taken out from the pure water, and then the secondary particles were cleaned and dried. Unnecessary pure water, a by-product, etc. were thereby removed. As a result, the toner base particles were obtained. Lastly, the toner base particles and the external additive were mixed with each other, to thereby obtain a mixture. Thereafter, the mixture was stirred for three minutes by means of a Henschel mixer, to thereby obtain the yellow toner.

The manufacturing method of each of the magenta toner, the cyan toner, and the black toner was similar to the foregoing manufacturing method of the yellow toner, except that corresponding one of the magenta colorant, the cyan colorant, and the black colorant was used in place of the yellow colorant.

As a method of manufacturing the white toner, the pulverization was used. Specifically, first, the white colorant, the first binder resin, the second binder resin, the release agent, and the electric charge control agent were mixed with each other, to thereby obtain a mixture. Thereafter, the mixture was stirred by means of a Henschel mixer, and then was subjected to melt kneading by means of a biaxial extruder, to thereby obtain a kneaded material. Thereafter, the kneaded material was cooled. Thereafter, the kneaded material was pulverized by means of a cutter mill having a screen with a diameter of 2 mm. The kneaded material was further pulverized by means of a collision-type pulverization apparatus, to thereby obtain a pulverized material. The collision-type pulverization apparatus used was a dispersion separator available from Nippon Pneumatic Mfg. Co., Ltd., Osaka, Japan. Thereafter, the pulverized material was classified by means of a wind force classifier, to thereby obtain the toner base particles. Lastly, the toner base particles and the external additive were mixed with each other, to thereby obtain a mixture. The mixture was stirred for three minutes by means of a Henschel mixer, to thereby obtain the white toner.

The volume average particle size of each of the yellow toner, the magenta toner, the cyan toner, the black toner, and the white toner was 7 μm. The foregoing volume average particle size was a result of measurement performed by means of a cell counting analyzer. The cell counting analyzer used was a coulter multisizer III available from Beckman Coulter, Inc., Calif., USA. Upon the measurement, the aperture diameter was set to 100 μm, and the counting number was set to 30000 counts.

The electric charge characteristics, i.e., the electric charge amount, of each of the yellow toner, the magenta toner, the cyan toner, the black toner, and the white toner, on the surface of the developing roller 34 was as follows.

Yellow toner: −24.4 μC/g
Magenta toner: −25.0 μC/g
Cyan toner: −26.6 μC/g
Black toner: −26.8 μC/g
White toner: −8.6 μC/g The electric charge characteristics, i.e., the electric charge amount, of each of the yellow toner, the magenta toner, the cyan toner, the black toner, and the white toner, on the surface of the photosensitive drum 32 was as follows.

Yellow toner: −29.7 μC/g
Magenta toner: −34.3 μC/g
Cyan toner: −33.9 μC/g
Black toner: −33.5 μC/g
White toner: −10.9 μC/g The foregoing electric charge amounts were a result of measurement performed by means of a suction-type electric charge amount measuring apparatus. The suction-type electric charge amount measuring apparatus used was Q/m meter MODEL 212HS available from Treck Japan KK, Tokyo, Japan. The absolute value of the electric charge amount of the white toner was greatly smaller than the absolute value of the electric charge amount of each of the yellow toner, the magenta toner, the cyan toner, and the black toner. Therefore, in the case where the white toner was used, there was a tendency that a remarkable degree of the phenomenon "overlapping" occurred easily compared to the case where each of the yellow toner, the magenta toner, the cyan toner, and the black toner was used.

The glass-transition temperature TG of the white toner was 52° C. The foregoing glass-transition temperature TG was a result of measurement performed by means of a differential scanning calorimeter. The differential scanning calorimeter used was DSC6220 available from Sii Nanotechnology, Inc., Chiba, Japan.

A procedure for measuring the glass-transition temperature TG was as follows. First, 10 mg of the white toner was used as a measurement sample. The temperature of the measurement sample was increased from 20° C. to 200° C. at a temperature increasing speed of 10° C./min. Thereafter, the temperature of the measurement sample was decreased from 200° C. to 0° C. at a temperature decreasing speed of 90° C./min. Thereafter, the temperature of the measurement sample was increased from 0° C. to 20° C. at a temperature increasing speed of 60° C./min. Thereafter, the temperature of the measurement sample was increased from 20° C. to 200° C. at a temperature increasing speed of 10° C./min. Lastly, a temperature corresponding to an intersection of a baseline and a tangent line to an endotherm curve was set as the glass-transition temperature TG, on the basis of the result of the measurement performed by means of the differential scanning calorimeter.

Thereafter, an image for evaluation was formed on the print medium M by means of the image forming apparatus mounted with the foregoing five types of toners, i.e., the yellow toner, the magenta toner, the cyan toner, the black toner, and the white toner. Upon the formation of the image for evaluation, the heating temperature TH was varied on the basis of the type of the toner, to thereby vary the fixing temperature (° C.) as indicated in Table 1.

It is to be noted that "Y, M, C, K, and W" in Table 1 represents the types of the toners. Specifically. "Y" represents the yellow toner, "M" represents the magenta toner, "C" represents the cyan toner, "K" represents the black toner, and "W" represents the white toner.

Figure 10:
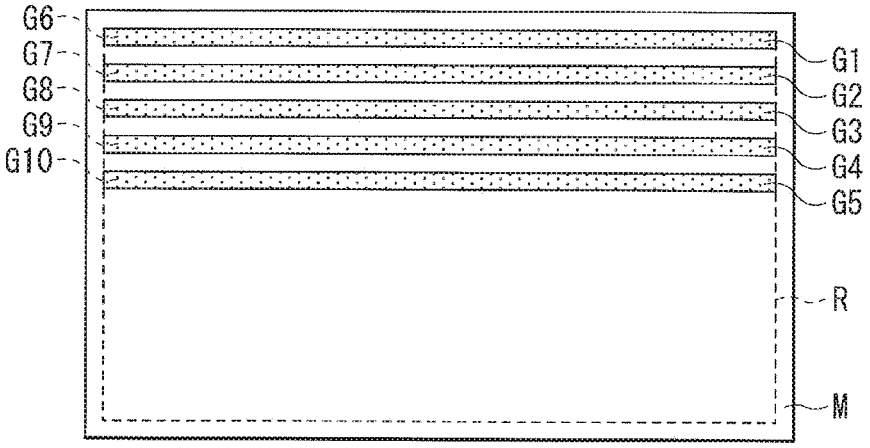
FIG. 10 is a plan view of an image for medium passing describing contents of the image for medium passing.
Figure 11:
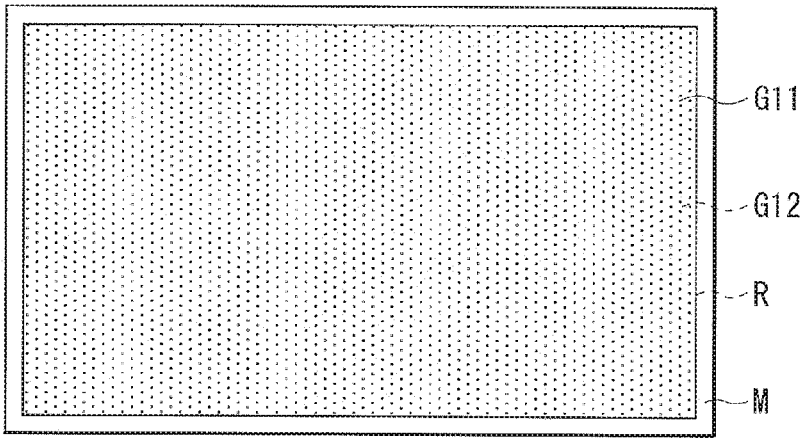
FIG. 11 is a plan view of an evaluation image describing contents of the evaluation image.

FIG. 10 illustrates a planar configuration of the print medium M on which an image for medium passing was formed, in order to describe the contents of the image for medium passing. FIG. 11 illustrates a planar configuration of the print medium M on which the image for evaluation was formed, in order to describe the contents of the image for evaluation. A direction in which the print medium M traveled upon the image formation was a vertical direction in each of FIGS. 10 and 11, that was, a shorter-side direction of the print medium M.

A region surrounded by a dashed line in each of FIGS. 10 and 11 represents an image formable region R. The image formable region R represents the maximum range in which an image was formable. Specifically, the image formable region R was a region on one side (the front surface or the back surface) of the print medium M, excluding a region having a width of 5 mm from the four edges of the print medium M.

When the image for evaluation was formed by means of the image forming apparatus, first, the images for medium passing was formed on both sides of the print medium M, until the total of the used media M reached 3000, in order to perform a medium passing test. When the image for medium passing was formed, the print medium M was fed at a speed of 191.1 mm/sec, and a time period from the formation of the image on the print medium M to the formation of the image on the next print medium M, i.e., an image formation interval, was set to 15 seconds.

Referring to FIG. 10, the image for medium passing included five horizontal-strip-like images G1 to G5 formed on the front surface of the print medium M, and five horizontal-strip-like images G6 to G10 formed on the back surface of the print medium M. The horizontal-strip-like images G1 and G6 were each a horizontal-strip-like continuous image formed by the use of the yellow toner. The horizontal-strip-like images G2 and G7 were each a horizontal-strip-like continuous image formed by the use of the magenta toner. The horizontal-strip-like images G3 and G8 were each a horizontal-strip-like continuous image formed by the use of the cyan toner. The horizontal-strip-like images G4 and G9 were each a horizontal-strip-like continuous image formed by the use of the black toner. The horizontal-strip-like images G5 and G10 were each a horizontal-strip-like continuous image formed by the use of the white toner. In FIG. 10, the horizontal-strip-like images G1 to G5 are shaded.

The horizontal-strip-like images G1 to G5 were provided in a forward region of the front surface of the print medium M in the traveling direction of the print medium M. Further, the horizontal-strip-like images G1 to G5 were also provided in this order from the forward region to a rearward region with spacing in between. The horizontal-strip-like images G6 to G10 were provided in a forward region of the back surface of the print medium M in the traveling direction of the print medium M. Further, the horizontal-strip-like images G6 to G10 were also provided in this order from the forward region to a rearward region with spacing in between. A width of each of the horizontal-strip-like images G1 to G10 was set to the maximum width in the image formable region R. It is to be noted that a printing rate at the time of the formation of each of the horizontal-strip-like images G1 to G10 was set to 5%.

After the foregoing medium passing test, i.e., the process of forming the image for medium passing, was completed, the images for evaluation was formed on both sides of the print medium M. The medium passing speed and the image formation interval at the time of the formation of the image for evaluation were set to be similar to those at the time of forming the image for medium passing.

Referring to FIG. 11, the image for evaluation included a rectangular image G11 and a rectangular image G12. The rectangular image G11 was formed in the entire image formable region R on the front surface of the print medium M. The rectangular image G12 was formed in the entire image formable region R on the back surface of the print medium M. The rectangular image G11 was a continuous image formed by the use of the white toner. The rectangular image G12 was a continuous image formed by the use of the black toner. In this case, the printing rate at the time of the formation of each of the rectangular images G11 and G12 was set to 100%. In FIG. 11, the rectangular image G11 is shaded.

The attachment situation of the toner and the fixing situation of the toner were examined on the basis of the image for evaluation, in order to evaluate the state of the image for evaluation. Results indicated in Table 1 were obtained by the evaluation.

When the attachment situation of the toner was examined, each of the surface of the pressure applying roller 52 and the rectangular image G12 formed on the back surface of the print medium M was visually examined. Thereby, the state of each of the pressure applying roller 52 and the rectangular image G12 was determined. Specifically, a case where no toner was attached to the surface of the pressure applying roller 52, and no toner was thereby attached to the rectangular image G12 was determined as "A". A case where the toner was attached to the surface of the pressure applying roller 52, but no toner was attached to the rectangular image G12 was determined as "B". A case where the toner was attached to the surface of the pressure applying roller 52, and in addition, the toner was attached to the rectangular image G12 was determined as "C".

When the fixing situation of the toner was examined, the rectangular image G11 formed on the front surface of the print medium M was visually examined. Thereby, the state of the rectangular image G11 was determined. Specifically, a case where the toner was fixed to the front surface of the print medium M sufficiently, and the toner was therefore not peeled off from the print medium M was determined as "A". A case where the toner was not fixed to the front surface of the print medium M sufficiently, and the toner was therefore peeled off from the print medium M was determined as "C".

TABLE 1

| | Fixing temperature (° C.) | | Attachment situation | | Fixing situation | |
|---|---|---|---|---|---|---|
| Example | Y, M, C, K | W | K | W | K | W |
| 1-1 | 140 | 120 | A | A | A | A |
| 1-2 | 160 | 140 | A | A | A | A |
| 1-3 | 170 | 150 | A | A | A | A |
| 1-4 | 180 | 160 | A | A | A | A |
| 1-5 | 140 | 140 | A | C | A | A |
| 1-6 | 160 | 160 | A | C | A | A |
| 1-7 | 170 | 170 | A | C | A | A |
| 1-8 | 180 | 180 | A | C | A | A |

As can be seen from Table 1, each of the attachment situation of the toner and the fixing situation of the toner were varied greatly in accordance with the fixing temperature.

Specifically, when the fixing temperature in the case where the white toner was used was set to be the same as the fixing temperature in the case where the yellow toner, etc. were used (Examples 1-5 to 1-8), the attachment situation of the toner differed depending on the type of the toner.

Specifically, in the case where the black toner was used, the black toner was fixed to the print medium M, and the black toner was not attached to the surface of the pressure applying roller 52. Therefore, it can be considered that, in the case where each of the yellow toner, the magenta toner, and the cyan toner is used, a result similar to that in the case where the black toner was used will be obtained. In contrast, in the case where the white toner was used, the white toner was fixed to the print medium M, but the white toner was attached to the surface of the pressure applying roller 52. As can be seen from the foregoing result, the phenomenon that the toner was attached to the back surface of the print medium M was unique to the white toner.

In contrast, when the fixing temperature in the case where the white toner was used was set to be lower than the fixing temperature in the case where the yellow toner, etc. were used (Examples 1-1 to 1-4), favorable results were obtained independently of the type of the toner.

Specifically, in the case where the black toner was used, the black toner was fixed to the print medium M, and the black toner, etc. were not attached to the surface of the pressure applying roller 52. In addition, similarly, in the case where the white toner was used, the white toner was fixed to the print medium M, and the white toner was not attached to the surface of the pressure applying roller 52.

Examples 2-1 to 2-9

An image was formed by the image forming apparatus according to the second example embodiment illustrated in FIGS. 1, 2, 6, and 7 and a state of the formed image was examined, by the following procedures.

The model number of the image forming apparatus, the specification of the print medium M, the types of the respective toners, the compositions of the respective toners, and the procedure for forming the image for evaluation were similar to those in Examples 1-1 to 1-8. The procedure for forming the image for evaluation included details of the image for medium passing and details of the image for evaluation. However, upon the formation of the image for evaluation, the pressure applying temperature TP (° C.) was varied as indicated in Table 2 in the fixing process in the case where the white toner was used, in place of varying the fixing temperature. The temperature difference ΔT (° C.) at the time of the fixing was thereby varied.

The attachment situation of the white toner and the fixing situation of the white toner were examined on the basis of the image for evaluation. Results indicated in Table 2 were obtained by the evaluation. The procedure for examining each of the attachment situation of the white toner and the fixing situation of the white toner was as described above.

TABLE 2

| Example | Pressure applying temperature TP (° C.) | Glass-transition temperature TG (° C.) | Temperature difference ΔT (° C.) | Attachment situation | Fixing situation |
|---|---|---|---|---|---|
| 2-1 | 110 | 52 | 58 | A | C |
| 2-2 | 120 | 52 | 68 | A | A |
| 2-3 | 130 | 52 | 78 | A | A |
| 2-4 | 140 | 52 | 88 | A | A |
| 2-5 | 146 | 52 | 94 | A | A |
| 2-6 | 150 | 52 | 98 | B | A |
| 2-7 | 151 | 52 | 99 | B | A |
| 2-8 | 153 | 52 | 101 | B | A |
| 2-9 | 160 | 52 | 108 | C | A |

As can be seen from Table 2, each of the attachment situation of the white toner and the fixing situation of the white toner were varied greatly in accordance with the temperature difference ΔT (° C.) at the time of the fixing.

Specifically, the attachment situation of the white toner was improved gradually as the temperature difference ΔT (° C.) at the time of the fixing was decreased. Further, the fixing situation of the white toner was improved gradually as the temperature difference ΔT (° C.) at the time of the fixing was increased.

In this case, the white toner was not attached to the back surface of the print medium M when the temperature difference ΔT (° C.) at the time of the fixing was from 68° C. to 101° C. (Examples 2-2 to 2-8), unlike when the temperature difference ΔT (° C.) at the time of the fixing was higher than 101° C. (Example 2-9). Further, the white toner was not peeled off from the print medium M when the temperature difference ΔT (° C.) at the time of the fixing was from 68° C. to 101° C. (Examples 2-2 to 2-8), unlike when the temperature difference ΔT (° C.) at the time of the fixing was lower than 68° C.

Accordingly, when the temperature difference ΔT (° C.) at the time of the fixing was from 68° C. to 101° C., it was possible to suppress the attachment of the white toner to the back surface of the print medium M while causing the white toner to be fixed to the print medium M.

In this case, in particular, when the temperature difference ΔT (° C.) at the time of the fixing was from 68° C. to 94° C., it was also possible to suppress attachment of the white toner to the surface of the pressure applying roller 52. Accordingly, it was possible to reduce the possibility of attachment of the white toner to the back surface of the print medium M.

Examples 3-1 to 3-9

As indicated in Table 3, the image for evaluation was formed by means of the image forming apparatus, and the state of the formed image was examined by a procedure similar to that in Examples 2-1 to 2-9, except that the composition of the white toner was changed.

The composition of the white toner used in Examples 3-1 to 3-9 was similar to the composition of the white toner used in Examples 1-1 to 1-8, except that the second binder resin, i.e., the crystalline polyester, was not included. The electric charge amount of the white toner on the surface of the developing roller 34 was −4.5 μC/g, and the electric charge amount of the white toner on the surface of the photosensitive drum 32 was −6.8 μC/g. Further, the glass-transition temperature TG of the white toner was 60° C.

TABLE 3

| Example | Pressure applying temperature TP (° C.) | Glass-transition temperature TG (° C.) | Temperature difference ΔT (° C.) | Attachment situation | Fixing situation |
|---|---|---|---|---|---|
| 3-1 | 110 | 60 | 50 | A | C |
| 3-2 | 120 | 60 | 60 | A | C |
| 3-3 | 128 | 60 | 68 | A | A |
| 3-4 | 140 | 60 | 80 | A | A |
| 3-5 | 146 | 60 | 86 | A | A |
| 3-6 | 150 | 60 | 90 | A | A |
| 3-7 | 151 | 60 | 91 | A | A |
| 3-8 | 154 | 60 | 94 | A | A |
| 3-9 | 161 | 60 | 101 | B | A |

As can be seen from Table 3, results similar to those in Table 2 were obtained even when the composition of the white toner was changed. Specifically, when the temperature difference ΔT (° C.) at the time of the fixing was from 68° C. to 101° C., it was possible to suppress the attachment of the white toner to the back surface of the print medium M while suppressing peeling off of the white toner from the print medium M. In particular, when the temperature difference ΔT (° C.) at the time of the fixing was from 68° C. to 94° C., it was also possible to suppress attachment of the white toner to the surface of the pressure applying roller 52.

From the results indicated in Table 1, when the fixing temperature in the case where the white toner was used was lower than the fixing temperature in the case where the yellow toner, etc. were used, at the time of fixing process, the stain on the print medium M resulting from the attachment of the white toner was prevented while the fixing characteristics of the white toner were ensured. Hence, it was possible to stably obtain a high-quality image.

Moreover, from the results indicated in Table 2, when the temperature difference ΔT at the time of the fixing satisfied the appropriate condition, i.e., 68° C.≤ΔT≤101° C., at the time of the fixing process of the white toner by means of the pressure applying roller 52, the stain on the print medium M resulting from the attachment of the white toner was prevented while the fixing characteristics of the white toner were ensured. Hence, it was possible to stably obtain a high-quality image.

The technology has been described above referring to the example embodiments and the modification examples thereof; however, the technology is not limited to the example embodiments and the modification examples described above, and is modifiable in various ways.

For example, the image forming apparatus according to one example embodiment is not limited to a printer, and may be a copying machine, a facsimile, a multi-functional apparatus, or any other suitable apparatus that forms an image.

It is possible to achieve at least the following configurations from the above-described example embodiments of the technology.

(1)

An Image Forming Apparatus Including:

a developing section that attaches a metal-containing toner to a latent image, and attaches a non-metal-containing toner to the latent image, the metal-containing toner including a metal-containing colorant, the non-metal-containing toner not including the metal-containing colorant;

a transfer section that transfers, onto an intermediate transfer medium, the metal-containing toner attached to the latent image and transfers, onto a print medium, the metal-containing toner transferred onto the intermediate transfer medium, the transfer section transferring, onto the intermediate transfer medium, the non-metal-containing toner attached to the latent image and transferring, onto the print medium, the non-metal-containing toner transferred onto the intermediate transfer medium; and a fixing section that fixes, to the print medium, the metal-containing toner transferred onto the print medium, and fixes, to the print medium, the non-metal-containing toner transferred onto the print medium, the fixing section causing a temperature at which the metal-containing toner is fixed to the print medium to be lower than a temperature at which the non-metal-containing toner is fixed to the print medium.

(2)

The image forming apparatus according to (1), in which an absolute value of an electric charge amount of the metal-containing toner is smaller than an absolute value of an electric charge amount of the non-metal-containing toner.

(3)

The image forming apparatus according to (1), in which the metal-containing toner includes binder resin including crystalline polyester.

(4)

The image forming apparatus according to (1), in which the metal-containing toner includes one or both of a white toner and a brilliant toner, and the non-metal-containing toner includes one or more of a yellow toner, a magenta toner, a cyan toner, and a black toner.

(5)

An Image Forming Apparatus Including:

a developing section that attaches a toner to a latent image;

a transfer section that transfers, onto an intermediate transfer medium, the toner attached to the latent image, and transfers, onto a print medium, the toner transferred onto the intermediate transfer medium; and a fixing section that includes a heating member and a pressure applying member, and fixes, to the print medium, the toner transferred onto the print medium, the heating member being disposed on side of the intermediate transfer medium on which the print medium comes into contact with the intermediate transfer medium and heating the print medium onto which the toner has been transferred, the pressure applying member facing the heating member and applying a pressure onto the print medium onto which the toner has been transferred, in which a difference ΔT between a temperature of the pressure applying member and a glass-transition temperature of the toner defined as the temperature of the pressure applying member minus the glass transition temperature of the toner satisfies the following conditional expression, when the fixing section fixes the toner to the print medium.

$$68° \text{ C.} \leq \Delta T \leq 101° \text{ C.}$$

(6)

The image forming apparatus according to (5), in which the toner includes a metal-containing toner, the metal-containing toner including a metal-containing colorant.

(7)

The image forming apparatus according to (6), in which the metal-containing toner includes binder resin including crystalline polyester.

(8)

The image forming apparatus according to (6), in which the metal-containing toner includes one or both of a white toner and a brilliant toner.

(9)

An Image Forming Apparatus Including:

a controller that switches between a first mode and a second mode, the first mode forming, by use of a toner, an image on one side of a print medium, the second mode forming, by use of the toner, the image on both sides of the print medium;

a developing section that attaches the toner to a latent image;

a transfer section that transfers, onto an intermediate transfer medium, the toner attached to the latent image, and transfers, onto the print medium, the toner transferred onto the intermediate transfer medium; and a fixing section that includes a heating member and a pressure applying member, and fixes, to the print medium, the toner transferred onto the print medium, the heating member heating the print medium onto which the toner has been transferred, the pressure applying member applying a pressure onto the print medium onto which the toner has been transferred, the fixing section causing a temperature of the pressure applying member in the second mode to be lower than a temperature of the pressure applying member in the first mode.

(10)

The image forming apparatus according to (9), in which the toner includes a metal-containing toner which is used in the second mode, the metal-containing toner being a toner including a metal-containing colorant.

(11)

The image forming apparatus according to (10), in which the metal-containing toner includes binder resin including crystalline polyester.

(12)

The image forming apparatus according to (10), in which the metal-containing toner includes one or both of a white toner and a brilliant toner.

According to the image forming apparatus of one embodiment of the technology, the temperature at which the fixing section fixes the metal-containing toner to the print medium is lower than the temperature at which the fixing section fixes the non-metal-containing toner to the print medium. Hence, it is possible to stably form a high-quality image.

According to the image forming apparatus of another embodiment of the technology, the difference ΔT between the temperature of the pressure applying member and the glass-transition temperature of the toner satisfies the condition 68° C.≤ΔT≤101° C. when the fixing section fixes the toner to the print medium. Hence, it is possible to stably form a high-quality image.

According to the image forming apparatus of still another embodiment of the technology, the fixing section causes the temperature of the pressure applying member in the second mode to be lower than the temperature of the pressure applying member in the first mode. The second mode forms the images on both sides of the print medium with the use of the toner. Hence, it is possible to stably form a high-quality image.

Each of the controller 71 illustrated in FIG. 4 and the controller 71 illustrated in FIG. 7 is implementable by circuitry that includes at least one application specific integrated circuit (ASIC), at least one semiconductor integrated circuit, and/or at least one field programmable gate array (FPGA). Non-limiting example of the at least one semiconductor integrated circuit may include at least one processor such as a central processing unit (CPU). At least one processor is configurable to perform all or a part of functions of each of the controller 71 illustrated in FIG. 4 and the controller 71 illustrated in FIG. 7, by reading instructions from at least one machine readable tangible non-transitory medium. Such a medium may take many forms. Non-limiting examples of the form of such a medium may include any type of magnetic medium such as a hard disk, any type of optical medium such as a CD and a DVD, any type of semiconductor memory (i.e., semiconductor circuit) such as a volatile memory and a non-volatile memory. Non-limiting examples of the volatile memory may include a DRAM and a SRAM. Non-limiting examples of the nonvolatile memory may include a ROM and a NVRAM. The ASIC is an integrated circuit (IC) customized to perform all or a part of the functions of each of the controller 71 illustrated in FIG. 4 and the controller 71 illustrated in FIG. 7. The FPGA is an integrated circuit designed to be configured after manufacturing in order to perform all or a part of the functions of each of the controller 71 illustrated in FIG. 4 and the controller 71 illustrated in FIG. 7.

Although the technology has been described in terms of exemplary embodiments, it is not limited thereto. It should be appreciated that variations may be made in the described embodiments by persons skilled in the art without departing from the scope of the invention as defined by the following claims. The limitations in the claims are to be interpreted broadly based on the language employed in the claims and not limited to examples described in this specification or during the prosecution of the application, and the examples are to be construed as non-exclusive.

What is claimed is:

1. An image forming apparatus comprising:

a first developing section that attaches a metal-containing toner to a first electrostatic latent image provided on a first electrostatic latent image supporting member, the metal-containing toner including a metal-containing colorant;

a second developing section that attaches a non-metal-containing toner to a second electrostatic latent image provided on a second electrostatic latent image supporting member, the non-metal-containing toner being free from including the metal-containing colorant;

a transfer section that transfers, onto an intermediate transfer medium, the metal-containing toner attached to the first electrostatic latent image and transfers, onto a print medium, the metal-containing toner transferred onto the intermediate transfer medium, the transfer section transferring, onto the intermediate transfer medium, the non-metal-containing toner attached to the second electrostatic latent image and transferring, onto the print medium, the non-metal-containing toner transferred onto the intermediate transfer medium; and a fixing section that fixes, to the print medium, the metal-containing toner transferred onto the print medium, and fixes, to the print medium, the non-metal-containing toner transferred onto the print medium, the fixing section causing a temperature upon the fixing that uses at least the metal-containing toner to be lower than a temperature upon the fixing that uses the non-metal-containing toner and that does not use the metal-containing toner.

2. The image forming apparatus according to claim 1, wherein an absolute value of an electric charge amount of the metal-containing toner is smaller than an absolute value of an electric charge amount of the non-metal-containing toner.

3. The image forming apparatus according to claim 1, wherein the metal-containing toner includes binder resin including crystalline polyester.

4. The image forming apparatus according to claim 1, wherein the metal-containing toner includes one or both of a white toner and a brilliant toner, and the non-metal-containing toner includes one or more of a yellow toner, a magenta toner, a cyan toner, and a black toner.

5. The image forming apparatus according to claim 1, wherein the transfer section includes:

a first primary transfer member that transfers, onto the intermediate transfer medium, the metal-containing toner attached to the first electrostatic latent image;

a second primary transfer member that transfers, onto the intermediate transfer medium, the non-metal-containing toner attached to the second electrostatic latent image; and a secondary transfer member that transfers, onto the print medium, the metal-containing toner transferred onto the intermediate transfer medium and the non-metal-containing toner transferred onto the intermediate transfer medium.

6. An image forming apparatus comprising:

a first developing section that attaches a first toner to a first electrostatic latent image provided on a first electrostatic latent image supporting member, the first toner being a white toner or a brilliant toner;

a second developing section that attaches a second toner to a second electrostatic latent image provided on a second electrostatic latent image supporting member, the second toner being a yellow toner, a magenta toner, a cyan toner, or a black toner;

a transfer section that transfers, onto an intermediate transfer medium, the first toner attached to the first electrostatic latent image and transfers, onto a print medium, the first toner transferred onto the intermediate transfer medium, the transfer section transferring, onto the intermediate transfer medium, the second toner attached to the second electrostatic latent image and transferring, onto the print medium, the second toner transferred onto the intermediate transfer medium; and a fixing section that fixes, to the print medium, the first toner transferred onto the print medium, and fixes, to the print medium, the second toner transferred onto the print medium, the fixing section causing a temperature upon the fixing that uses at least the first toner to be lower than a temperature upon the fixing that uses the second toner and that does not use the first toner.

7. The image forming apparatus according to claim 6, wherein the first developing section comprises two or more first developing sections, and the second developing section comprises two or more second developing sections.

8. The image forming apparatus according to claim 7, wherein the one or two or more first developing sections comprises two or more first developing sections, the two or more first developing sections containing the respective first toners that are different in kind from each other, and the one or two or more second developing sections comprises two or more second developing sections, the two or more second developing sections containing the respective second toners that are different in color from each other.

9. The image forming apparatus according to claim 6, wherein the transfer section includes:

a first primary transfer member that transfers, onto the intermediate transfer medium, the first toner attached to the first electrostatic latent image;

a second primary transfer member that transfers, onto the intermediate transfer medium, the second toner attached to the second electrostatic latent image; and a secondary transfer member that transfers, onto the print medium, the first toner transferred onto the intermediate transfer medium and the second toner transferred onto the intermediate transfer medium.

* * * * *